US007354238B2

(12) United States Patent
Fukudome et al.

(10) Patent No.: US 7,354,238 B2
(45) Date of Patent: Apr. 8, 2008

(54) WORK VEHICLE

(75) Inventors: Hiroki Fukudome, Sakai (JP); Tadashi Nakao, Sakai (JP); Shuichi Takeshita, Sakai (JP)

(73) Assignee: Kubota Corporation, Osaka (JP)

( * ) Notice: Subject to any disclaimer, the term of this patent is extended or adjusted under 35 U.S.C. 154(b) by 95 days.

(21) Appl. No.: 11/226,896

(22) Filed: Sep. 14, 2005

(65) Prior Publication Data

US 2006/0182598 A1 Aug. 17, 2006

(30) Foreign Application Priority Data

Jan. 27, 2005 (JP) ..... 2005-020085

(51) Int. Cl.
*E02F 3/00* (2006.01)

(52) U.S. Cl. ..... 414/686; 172/274; 414/722

(58) Field of Classification Search ..... 414/722, 414/686; 172/272, 274
See application file for complete search history.

(56) References Cited

U.S. PATENT DOCUMENTS 5,129,780 A * 7/1992 Stumpe ..... 414/686
5,531,561 A * 7/1996 Rae et al. ..... 414/686
6,231,295 B1 * 5/2001 Girstenbrei et al. ..... 414/686

FOREIGN PATENT DOCUMENTS

JP 10-280465 4/1997

* cited by examiner

*Primary Examiner*—Donald Underwood
(74) *Attorney, Agent, or Firm*—The Webb Law Firm

(57) ABSTRACT

A work vehicle includes a pair of, right and left booms detachably attached to a vehicle body, an implement attached to leading ends of the booms and a stand for supporting the booms with the implement being placed on a ground surface when the booms are detached from the vehicle body. The stand includes a pair of, right and left stand members provided in correspondence with the right and left booms and a stand connecting member for interconnecting the stand members. Each stand member is attached to the boom corresponding thereto in such a manner that the stand is movable between a use position in which each stand member projects downwardly from the boom for supporting the boom and a non-use position in which each stand member extends along the boom.

11 Claims, 16 Drawing Sheets

WORK VEHICLE

BACKGROUND OF THE INVENTION

1. Field of the Invention

The present invention relates to a work vehicle. More particularly, the invention relates to a tractor-mounted loader comprised of a tractor, as an example of the work vehicle, equipped with an implement such as a front loader detachably attached to a front portion of the tractor. It is understood, however, that the invention is not limited thereto.

2. Description of the Related Art

Conventionally, there is known a tractor-mounted loader comprised of a tractor with a front loader detachably attached to a front portion thereof (see Japanese Patent Application "Kokai" No. 10-280465).

The front loader includes a pair of, right and left booms, and a bucket attached to front ends of the right and left booms. A rear end of the right/left booms is pivotally connected to a corresponding side frame which in turn is detachably attached to a main frame mounted on the tractor.

The front loader further includes stands for supporting the booms with the bucket placed on the ground surface when the front loader is dismounted from the tractor.

Such stands are provided in a pair, right and left in correspondence with the pair of right and left booms. And, a front end of each stand is pivoted to the boom, so that as the stand is vertically pivoted about this pivot portion, the stand can be switched over between a use position in which the stand projects downwardly from the boom to contact the ground surface for supporting this boom and a non-use position in which the stand extends along the boom.

With the conventional tractor-mounted loader described above, each right/left stand is independently and separately attached to the boom corresponding thereto. Hence, when the front loader is mounted or dismounted, these stands need to be operated independently of each other. And, for lifting up/down each stand, an operator would need to go to the right/left outer side of the left boom (i.e. the left side of the vehicle) and also to the right/left outer side of the right arm (i.e. the right side of the vehicle). This was troublesome.

SUMMARY OF THE INVENTION

In view of the above-described state of the art, a primary object of the present invention is to provide a work vehicle which solves the above-described problem.

For accomplishing the above-noted object, the present invention proposes a work vehicle comprising:

a pair of, right and left booms detachably attached to a vehicle body;

an implement attached to leading ends of the booms; and a stand for supporting the booms with the implement being placed on a ground surface when the booms are detached from the vehicle body;

wherein said stand includes a pair of, right and left stand members provided in correspondence with the right and left booms and a stand connecting member for interconnecting said stand members, said each stand member being attached to the boom corresponding thereto in such a manner that the stand is movable between a use position in which each stand member projects downwardly from the boom for supporting the boom and a non-use position in which each stand member extends along the boom.

With the above-described construction, with an operation from either only one, right or left, side of the vehicle, the stand can be changed in its position between the use position and the non-use position.

According to one preferred embodiment of the invention, said right and left booms are interconnected at longitudinally intermediate portions thereof via a boom connecting member, and said stand connecting member, at its non-use position, is disposed along said boom connecting member so as to cover a hydraulic pipe disposed along said boom connecting member from under the pipe.

According to one preferred embodiment of the present invention, said each stand member comprises an assembly of separate components consisting essentially of a front component disposed on a front side of the stand connecting member and a rear component disposed on a rear side of the stand connecting member.

Further and other features and advantages thereof will become apparent upon reading the following detailed description of the invention with reference to the accompanying drawings.

DESCRIPTION OF THE PREFERRED EMBODIMENTS

Next, preferred embodiments of the invention will be described with reference to the accompanying drawings.

In all the embodiments to be disclosed herein, the direction along which the vehicle travels forward or reverse will be referred to as "a fore/aft direction", the horizontal direction normal to this fore and aft direction will be referred to as "a right/left direction" and the direction normal to both the fore/aft direction and the right/left direction will be referred to as "a vertical direction", respectively.

First Embodiment

Figure 1:
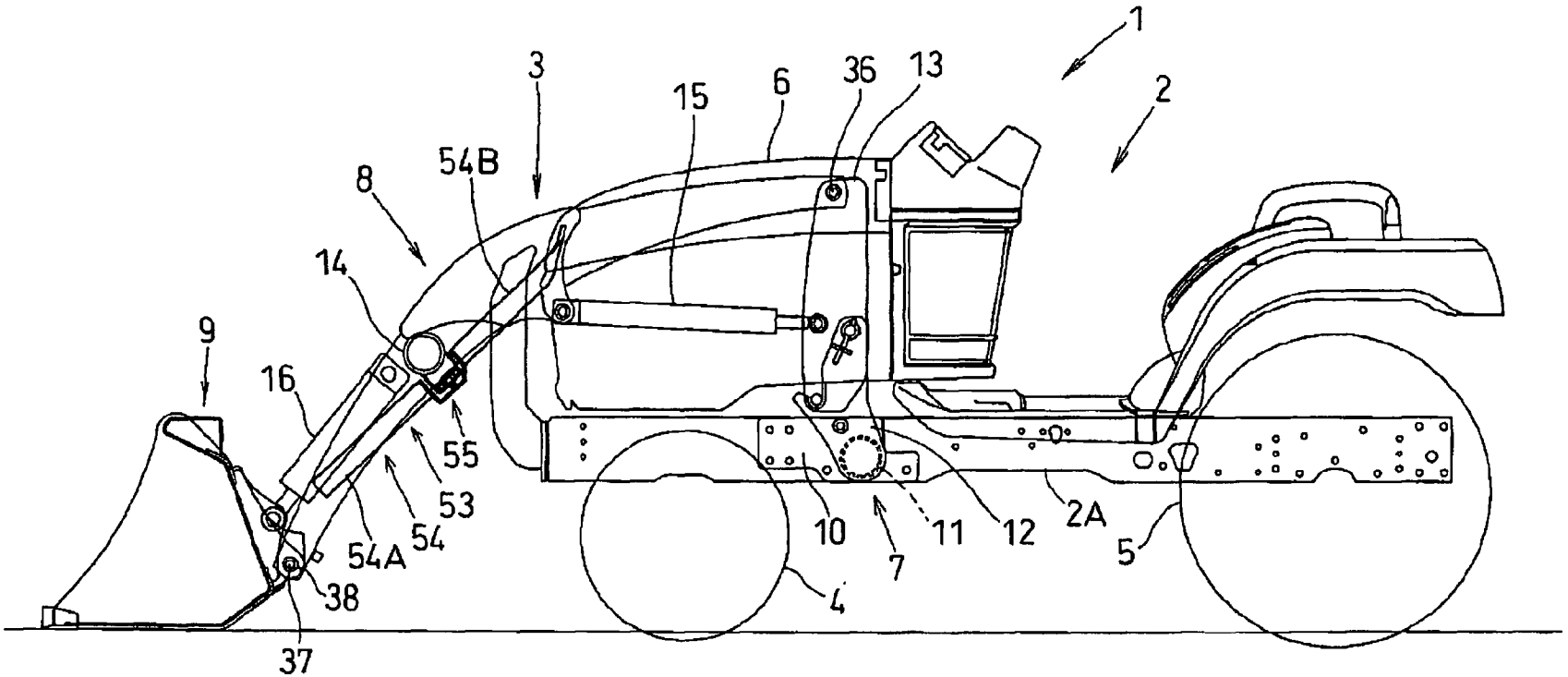
FIG. 1 is a side view of a work vehicle relating to a first embodiment of the present invention, showing a tractor-mounted loader as an example of such a work vehicle.

Referring to FIG. 1, a tractor-mounted loader 1, an example of a work vehicle relating to the present invention, includes a tractor 2 (an example of vehicle) and a front loader 3 mounted to a front portion of the tractor 2.

The tractor 2 is a two-axle, four-wheel type tractor including a pair of, right and left, front wheels 4 and a pair of, right and left, rear wheels 5. A hood 6 is provided at the front portion of the tractor 2 for covering an engine, a radiator, etc. The hood 6 has a curved shape at its upper surface, etc.

The front loader 3 includes a pair of, right and left side frames 13 detachably attached to a pair of, right and left attaching frames 7 mounted on the tractor 2, respectively; a pair of, right and left booms 8 having their base portions pivotally connected to the respective side frames 13; and a bucket (an example of an implement) 9 attached to the leading ends of the right and left booms 8.

Figure 10:
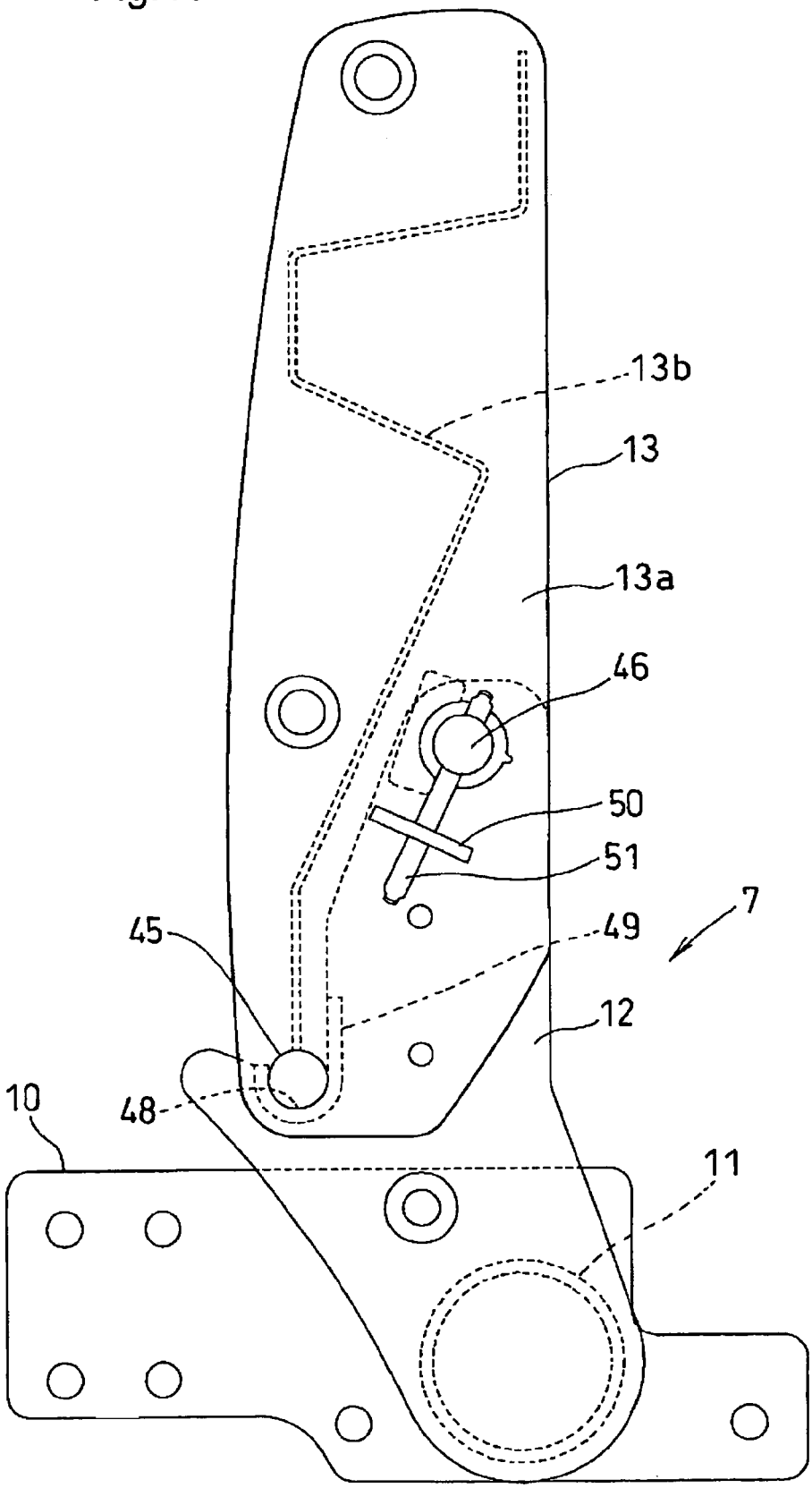
FIG. 10 is a side view showing an attaching frame and a side frame.
Figure 11:
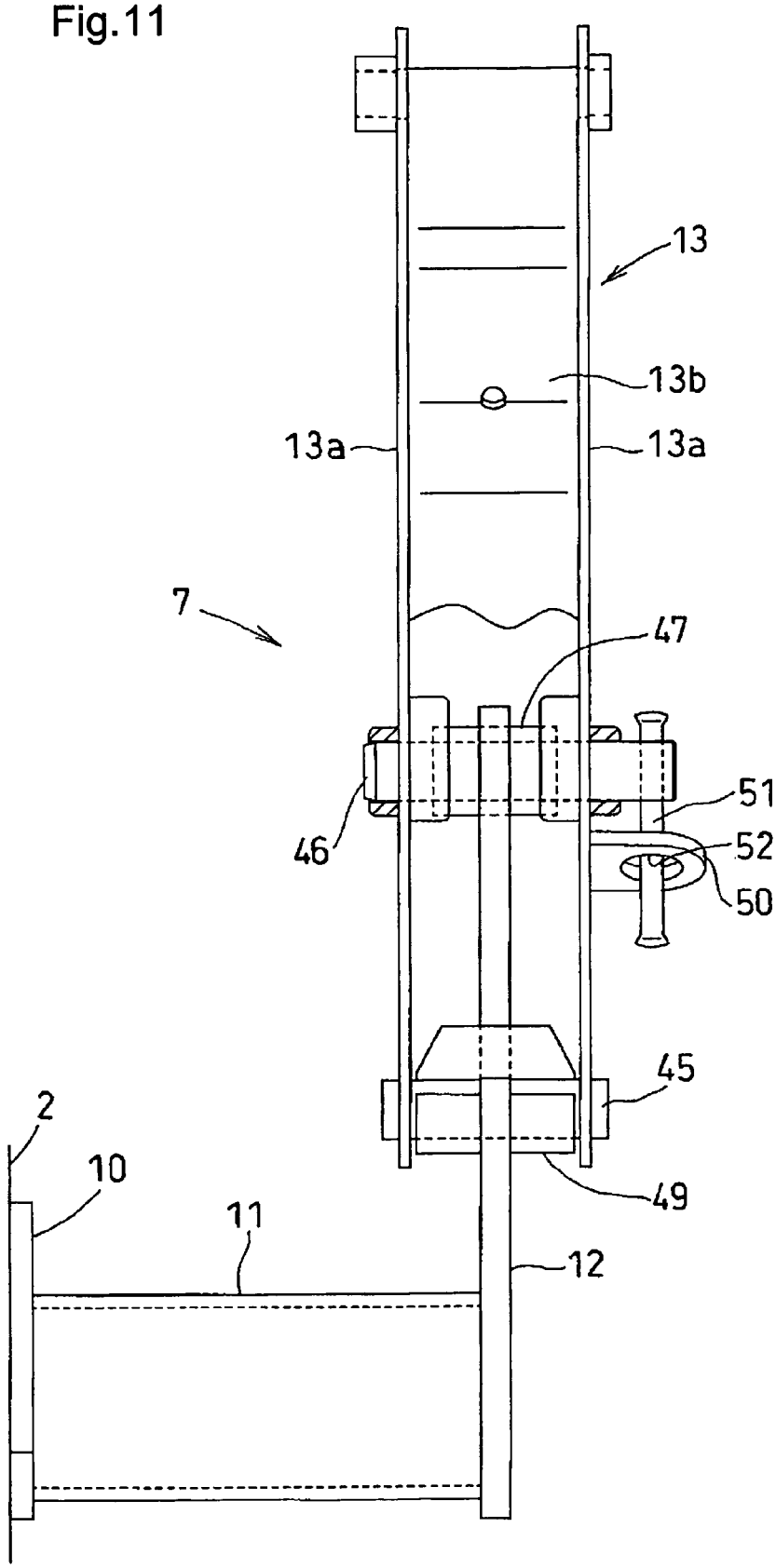
FIG. 11 is a front view of the attaching frame and the side frame.

Each attaching frame 7, as shown in FIGS. 10 and 11, includes a support base 11 provided under the front portion of the tractor 2 (downwardly of the rear end of the hood 6) and projecting outward from the tractor 2 along a right/left direction; a main frame 12 mounted on the support base 11 and projecting upward from the support base 11; and a pair of, right and left attaching plates 10 fixed to the right/left inner end sides of the support base 11 and fixedly attached to a vehicle frame 2A.

Figure 2:
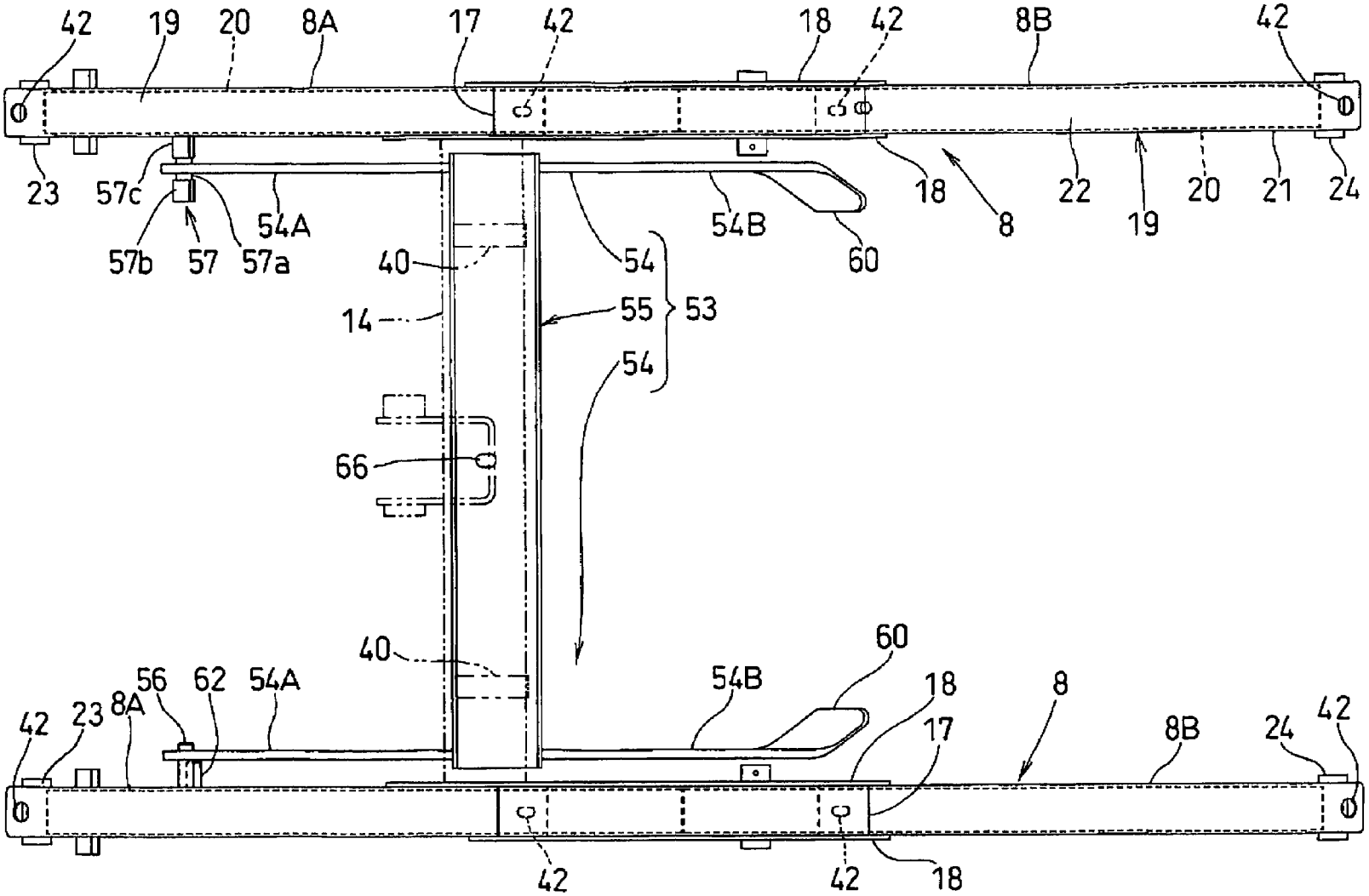
FIG. 2 is a view showing booms and a stand of the loader in FIG. 1 as seen from an obliquely upper position thereof.

As shown in FIG. 2, the booms 8 and the side frames 13 are provided respectively as a right and left pair and are disposed on the right and left opposed sides of the hood 6. The right and left booms 8 are interconnected, at their front sides, via a cylindrical boom connecting member 14. Each side frames 13 is attached to the main frame 12 on the same, right or left side.

Each of the right and left booms 8 is pivotally connected via a pivot shaft 36 to an upper portion of the corresponding side frame 13 disposed on the same, right or left side to be pivotable about a right/left axis, so that the boom 8 can be pivoted vertically.

Further, from a longitudinal intermediate portion of each right/left boom 8 through a vertical intermediate portion of each right/left side frame 13, there is incorporated a boom cylinder 15 comprised of a double-acting hydraulic cylinder. In association with expansion/contraction of these right and left boom cylinders 15, the right and left booms 8 can be pivoted vertically.

At a lower portion of a rear face of the bucket 9, there are provided a pair of, right and left brackets 38, and the leading end (front end) of the boom 8 on the same right/left side is pivotally connected thereto via a pivot shaft 37. Between a right/left center portion of the rear face of the bucket 9 and a right/left center portion of the boom connecting member 14, there is incorporated a single bucket cylinder 16 comprised of a double-acting hydraulic cylinder. Then, in association with expansion/contraction of this bucket cylinder 16, the bucket 9 can be pivoted (for scooping or dumping action).

Figure 3:
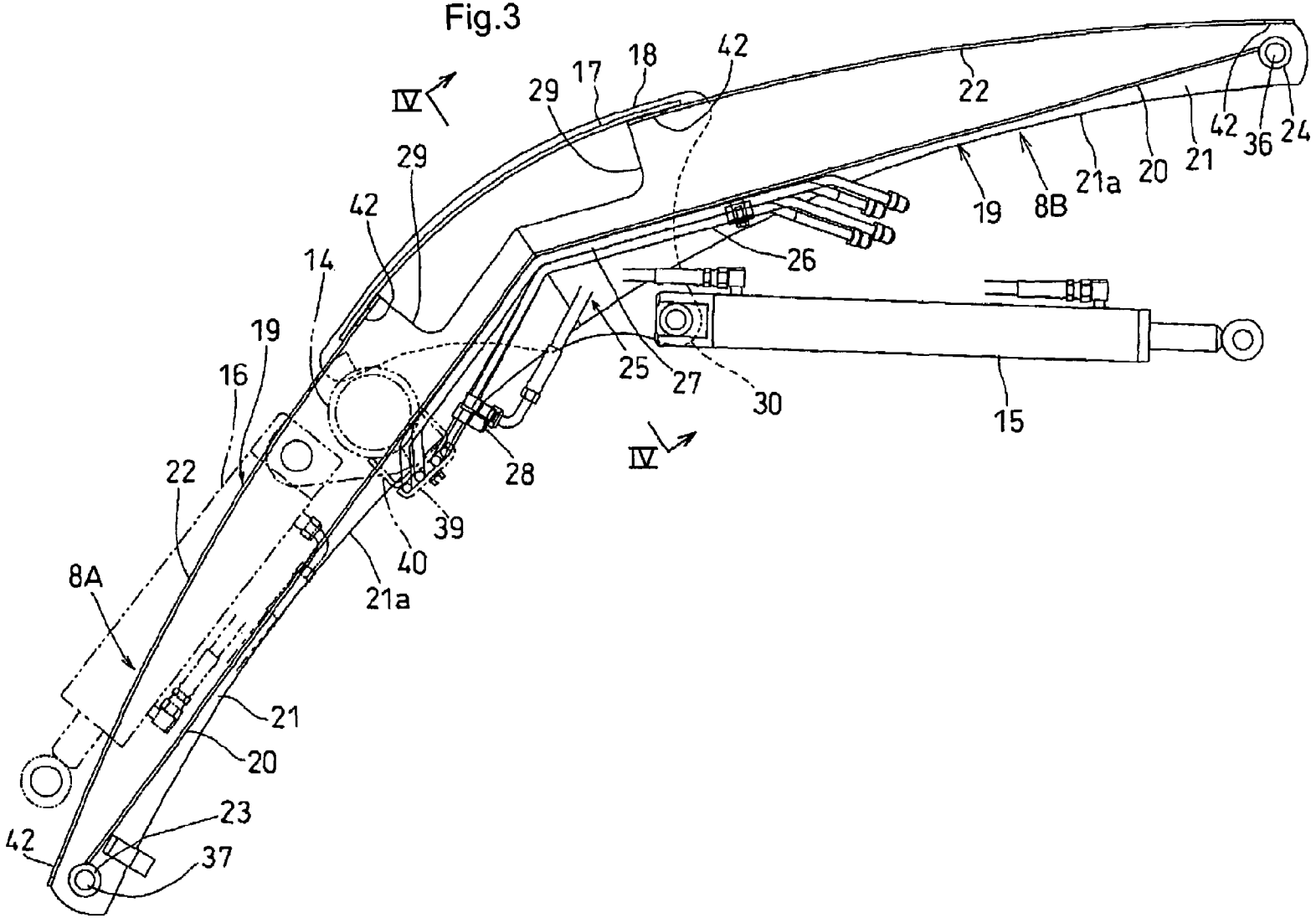
FIG. 3 is a side view in section of the boom.

The right/left boom 8, as shown in FIG. 1 through FIG. 3, is bent at a longitudinal center portion thereof to present an upwardly convex arc shape and the vertical width of the boom progressively increases from the front or rear end toward the longitudinal center portion.

Further, this boom 8 includes, as principal components thereof, a front boom component 8A provided on the front side relative to the longitudinal center portion, a rear boom component 8B provided on the rear side relative to the longitudinal center portion, a center connecting plate 17 interconnecting the front and rear boom components 8A, 8B at the longitudinal center portion of the boom 8, and a pair of side plates 18 disposed on the right and left sides at the longitudinal center portion of the boom 8.

Each of the front and rear boom components 8A, 8B consists of a main body 19 and a bottom plate 20. Further, the front and rear boom components 8A, 8B have an identical shape to each other so as to be formed of same components.

The main body 19 consists essentially of a pair of, right and left lateral plates 21 and a top plate 22 interconnecting upper edges of the respective lateral plates 21, the main body having a downwardly open reverse U-shape cross section and having an upwardly convex arc shape.

More particularly, the main body 19 of the front/rear boom component 8A, 8B is formed by bending a single plate member into the reverse U-shaped cross section and after being bent into this reverse U-shaped cross section, the plate is bent into the upwardly convex curved shape.

Further, an upper face (the upper face of the top plate 22) and a lower edge (lower edge 21*a* of the right/left later plate 21) of the main body 19 of the front/rear boom component 8A, 8B are bent into an arc face having a predetermined radius of curvature.

With the above, the upper face of the boom 8 is formed as a curved face from its front end to its rear end so as to aesthetically match the curved shape of the hood 6.

Further, at the front end of the front boom component 8A, there is provided a front pivot portion 23 comprised of a cylindrical member extending between and through the right and left lateral plates 21 and fixedly welded to these lateral plates 21. Then, by inserting the pivot shaft 37 through this front pivot portion 23 and the bracket 38 provided on the back face, the bucket 9 is pivotally connected so as to be pivotable about the right/left axis.

Similarly, at the rear end of the rear boom component 8B, there is provided a rear pivot portion 24 comprised of a cylindrical member extending between and through the right and left lateral plates 21 and fixedly welded to these lateral plates 21. Then, by inserting the pivot shaft 36 through the rear pivot portion 24 and the side frame 13, the boom 8 is pivotally connected to the side frame 13 to be pivotable about the right/left axis.

Further, the rear portions of the lateral plates 21 on the right/left inner sides of the right and left front boom components 8A, 8B are connected together via the boom connecting member 14.

The bottom plate 20 is comprised of a flat plate and is disposed downwardly of the top plate 22 and between the right and left lateral plates 21 so as to extend from portions of the front and rear boom components 8A, 8B at the ends thereof adjacent the longitudinal center portion of the boom 8 to the front and rear pivot portions 23, 24. After the main body 19 is bent as described above, right and left lateral edges of the bottom plate 20 are fixedly welded to the inner faces of the right and left lateral plates 21.

Further, one front/rear end of this bottom plate 20 is placed in abutment against the front and rear pivot portions 23, 24 and the other front/rear end of the plate 20 is disposed at a vertical width intermediate portion at the longitudinal center portion of the boom 8 (the vertical intermediate portions of the lateral plates 21 adjacent the edges of the longitudinal center portion of the boom 8). The bottom plate 20 is disposed closest, at its longitudinal intermediate portion, to the lower edges of the lateral plates 21 and a distance from the bottom plate 20 to the lower edges 21*a* of the lateral plates 20 progressively increases from the intermediate portion of bottom plate 20 toward the longitudinal center portion of the boom 8. With this, at the longitudinal center portion of the boom 8 and downwardly of the bottom plate 20 and between the right and left lateral plates 21, there is formed a pipe accommodating space 25.

Figure 4:
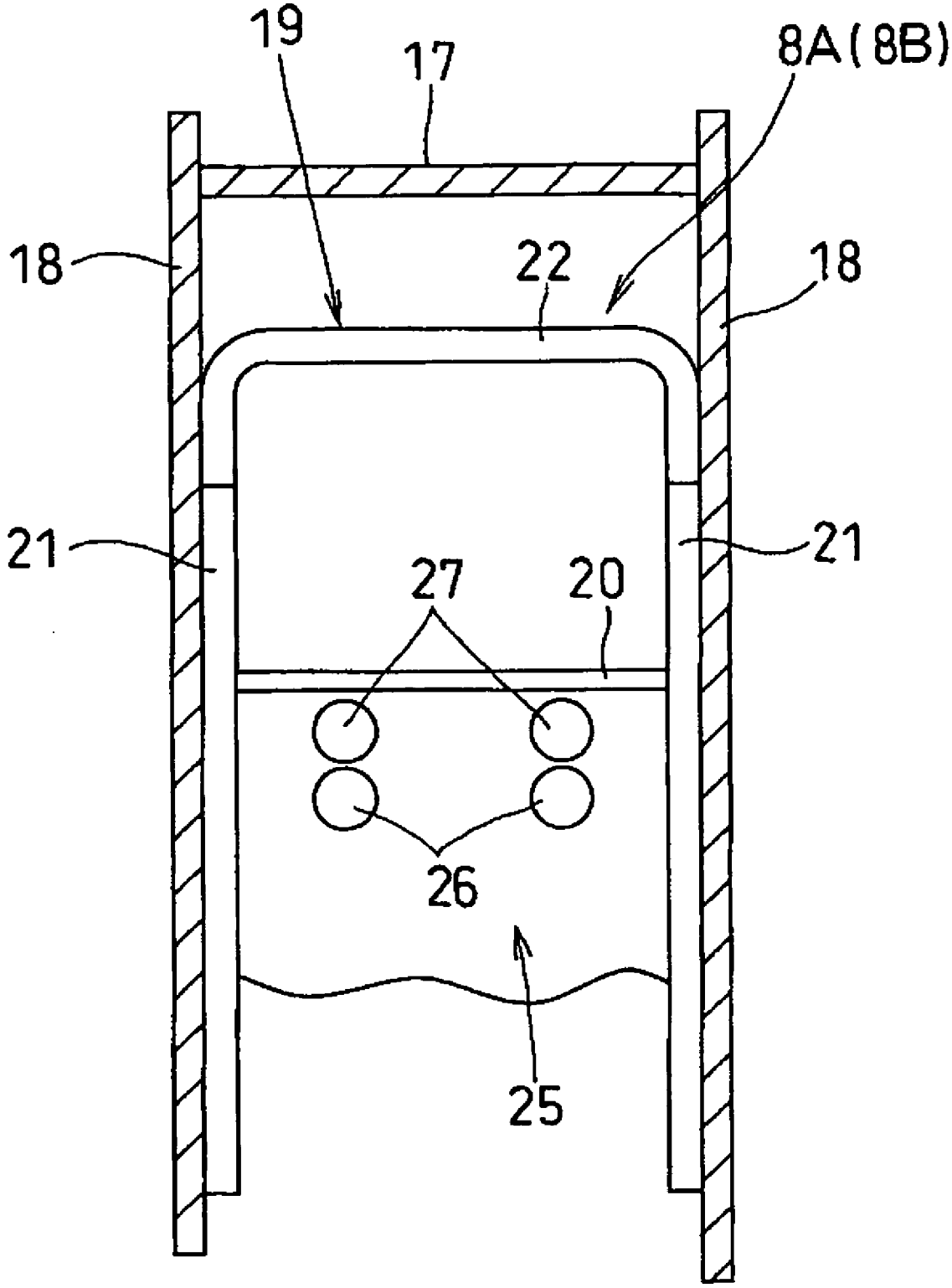
FIG. 4 is a section taken along a line IV-IV in FIG. 3.

As shown in FIGS. 3 and 4, within the pipe accommodating space 25 of one right/left boom 8 (the right boom in this embodiment), hydraulic pipes 26, 27 are accommodated.

The total of four hydraulic pipes 26, 27 are provided, i.e. two for the boom cylinders 15 and the other two for the bucket cylinder 16, with these pipes being arranged along the bottom plate 20.

Rear portions of the respective hydraulic pipes 26, 27 are connected via hydraulic hoses to a control valve unit mounted on the right main frame 12, etc.

The front portions of the hydraulic pipes 26 for the boom cylinders 15 are arranged under the connecting member 14 and on the left 5 side along this connecting member 14 and then are connected via the hydraulic hose to the left boom cylinder 15. Also, at its right front portion, the hydraulic pipe 26 is branched by a branching member 28 which member 28, in turn, is connected via a hydraulic hose to the right boom cylinder 15.

The hydraulic pipes 27 for the bucket cylinder 16 are arranged under the connecting member 14 and on the left side along this connecting member 14. And, these pipes 27 are connected via hydraulic hoses at a right/left center portion of the connecting member 14 to the bucket cylinder 16.

As shown also in FIG. 5, on the right and left sides of the lower face of the boom connecting member 14 interconnecting the right and left booms 8, there is provided an attaching table 40 for attaching a clamp member 39 for attaching the hydraulic pipes 26, 27 disposed along the lower face of the boom connecting member 14.

As described above, because of the large distance from the bottom plate 20 to the lower edges 21*a* of the lateral plates 21 at the right/left center of the boom 8 and also the narrow width between the right and left lateral plates 21, when the bottom plate 20 is to be welded to the lateral plates 21, it may be difficult to bring a welding torch between the lateral plates 21 at the longitudinal center of the boom 8 in order to weld the bottom plate 20 to the lateral plates 21 at the longitudinal center portion of the boom 8.

Therefore, the main body 19 of each front and rear boom component 8A, 8B each defines a cutaway portion 29 at the upper portion of the longitudinal center portion of the boom 8. Then, from each front/rear end of the boom 8 through the longitudinal intermediate portion of the boom 8, the bottom plate 20 is welded to the lateral plates 21 from the under side, whereas at the longitudinal center portion of the boom 8, the bottom plate 20 is welded to the lateral plates 21 from the upper side.

The cutaway portion 29 is formed by cutting away a predetermined longitudinal portion of the top plate 22 from an end thereof adjacent the longitudinal center portion of the boom 8 and cutting away also portions of the right and left lateral plates 21 from the cutaway portion of the top plate 22 to vertical width intermediate portions of the lateral plates 21.

For interconnecting the front and rear boom components 8A, 8B, first the bottom plates 20 are fixedly welded to the respective main bodies 19. These boom components 8A, 8B are then placed in abutment against each other to inter-weld the front and rear bottom plates 20. Then, the center connecting plate 17 and the right and left side plates 18 are welded to the boom components 8A, 8B.

The center connecting plate 17 is formed by bending a flat plate into an upwardly convex curved shape and this plate 17 is disposed between and across the top plates 22 of the front and rear boom components 8A, 8B.

The radius of curvature of this center connecting plate 17 is set smaller than the radius of curvature of the upper faces of the front and rear boom components 8A, 8B.

Therefore, when it is desired to form the boom 8 having such different radii of curvature in its upper face at the longitudinal center portion and the front and rear sides, such a boom 8 can be manufactured easily by the above-described interconnection of the members having different radii of curvature from each other.

The right and left side plates 18 are provided at the longitudinal center portion of the boom 8 along and between the lateral plates 21 of the front and rear boom components 8A, 8B. At a lower portion of each right/left side plate 18, there is provided a cylinder pivot portion 30 projecting downwardly from the boom 8. And, to this cylinder pivot portion 30, the boom cylinder 15 is pivotally connected.

In the meantime, the right/left inner side plate 18 extends more forwardly than the right/left outer side plate 18 and defines a hole 41 for allowing insertion of the connecting member 14.

At the front and rear ends of the top plate 22 of the front boom component 8A and the front and rear ends of the top plate 22 of the rear boom component 8B, there are respectively formed guide holes 42 for use in positioning during the respective bending operations of the main bodies 19 of the font and rear boom components 8A, 8B.

Figure 9A:
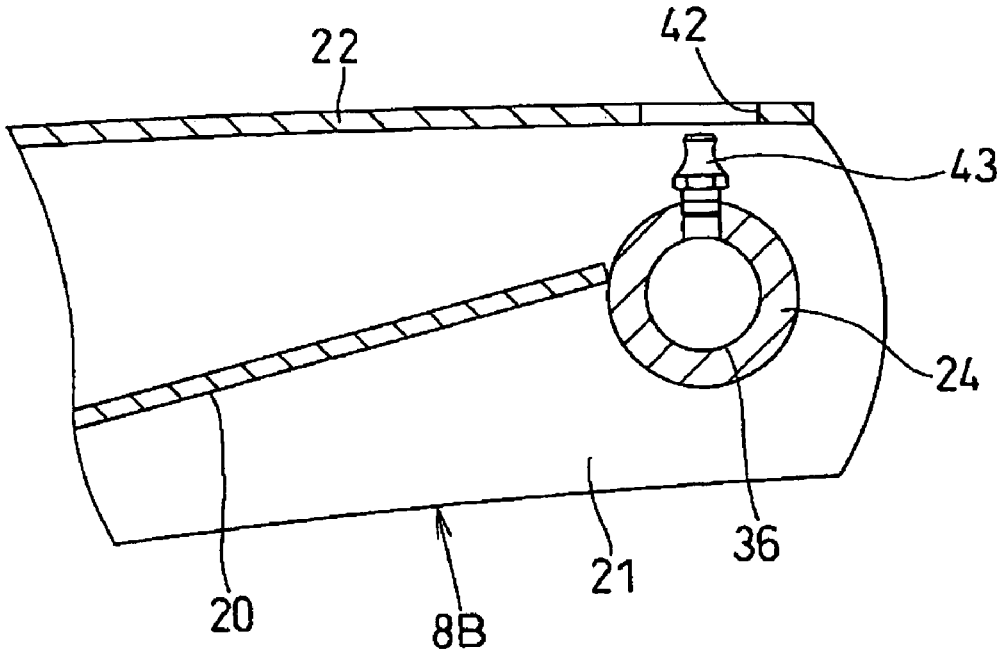
FIG. 9A is a side vide in section of a base portion of the boom.
Figure 9B:
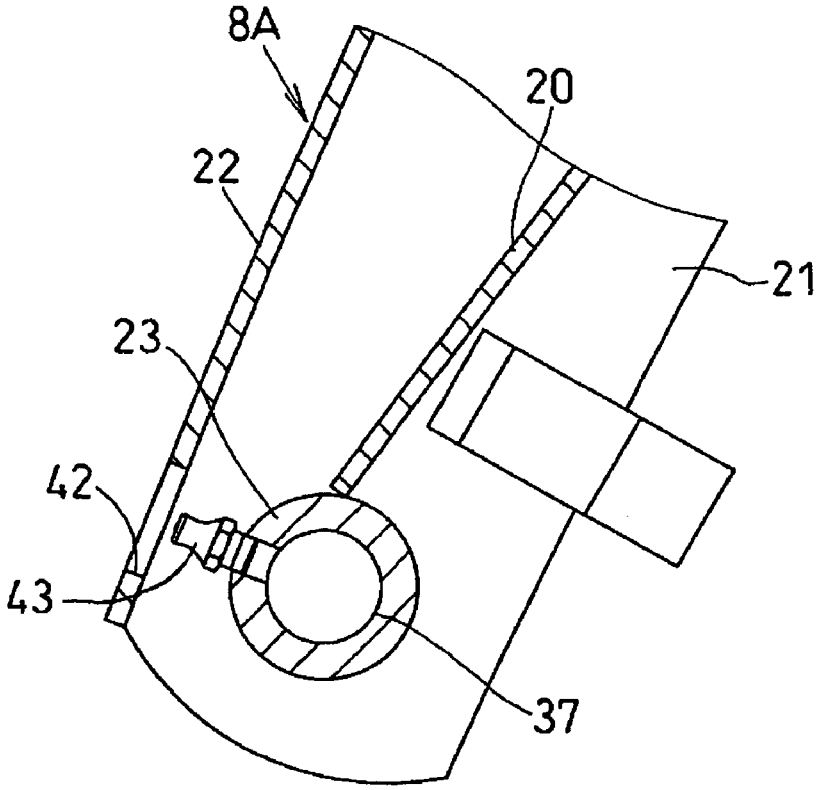
FIG. 9B is a side view in section of a leading end of the boom.

Further, at the front pivot portion 23 and the rear pivot portion 24, there are provided grease nipples 43 for feeding grease to outer peripheral portions of the pivot shafts 36, 37. As shown in FIG. 9, these grease nipples 43 are provided at positions corresponding to the guide holes 42 formed at the front end of the top plate 22 of the front boom component 8A and the rear end of the top plate 22 of the rear boom component 8B, and the guide holes 42 act also as grease feeding openings. With these arrangements, the grease nipples 43 are protected by the top plates 22 of the front and rear boom components 8A, 8B.

In particular, if the grease nipple 43 provided at the bucket pivot portion at the front end of the front boom component 8A were provided on the front end face of the front pivot portion 23 in the longitudinal direction of the boom, such a nipple 43 could readily be damaged by gravel or the like. Therefore, a cover member would need to be separately provided for protecting this grease nipple 43, thus inviting cost increase. On the other hand, the above-described construction of the present embodiment does not invite any cost increase.

As shown in FIGS. 10-12, the side frame 13 consists of a pair of, right and left lateral walls 13*a* and a connecting wall 13*b* interconnecting the right and left lateral walls 13*a*.

At a lower end front portion of this side frame 13, there is provided an engaging pin 45 having a right/left axis. And, this engaging pin 45 extends through the right and left lateral walls 13*a* of the side frame 13 to be fixed to these lateral walls 13*a*. The side frame 13, at its vertical intermediate rear portion, allows insertion and extension of a mount pin 46 through and between the right and left lateral walls 13*a* along the right/left direction.

Further, the main frame 12, which is formed of a thick plate, is fixed to a right/left outer end portion of the support base 11 and a portion of this frame 12 from its vertical intermediate portion to its upper portion is inserted between the right and left lateral walls 13*a* of the side frame 13. And, through the upper portion of this main frame 12, a cylindrical member 47 having a right/left axis extends along the right/left direction. And, at a front portion of the vertical intermediate portion, there is fixedly attached a receiving member 49 having an upwardly open arcuate concave groove 48.

Then, as the engaging pin 45 of the side frame 13 is engaged from above into the concave groove 48 of the receiving member 49 and the mount pin 46 is inserted between and the across the side frame 13 and the cylindrical member 47 of the main frame 12, the side frame 13 is attached to the main frame 12.

Figure 12B:
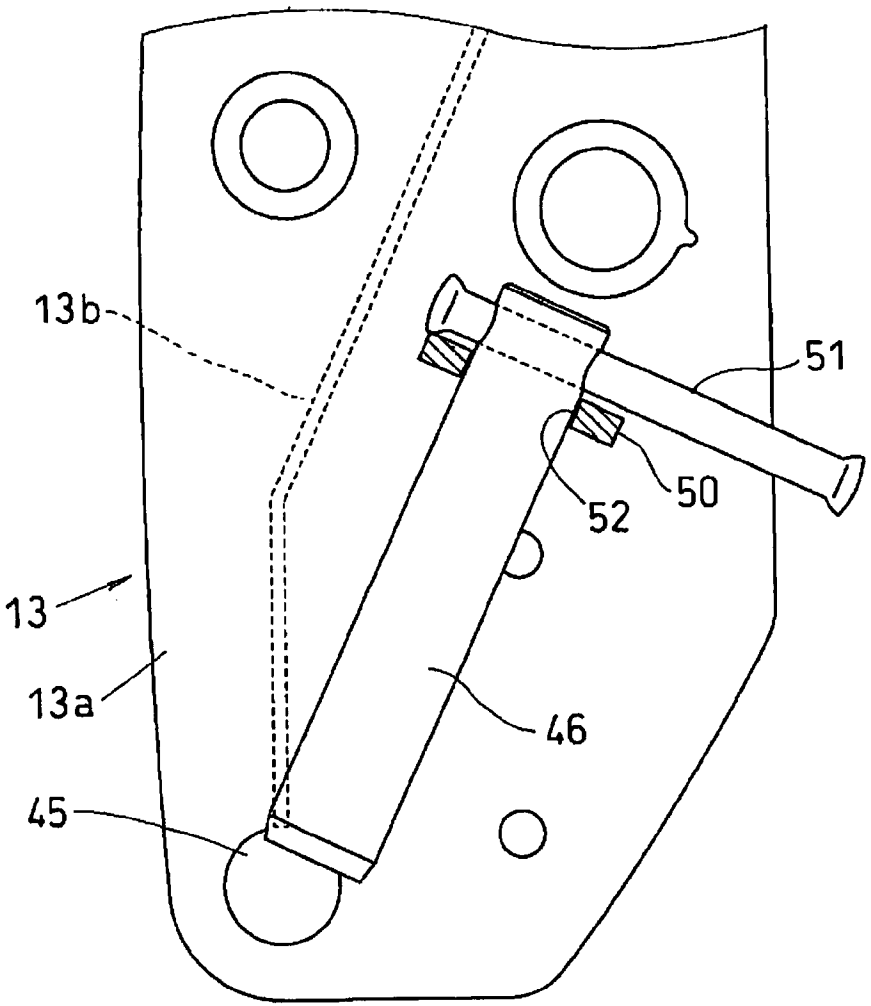
FIG. 12B is a side view showing a condition where the mount pin is withdrawn from the main frame and the side frame and then is retained to the main frame.
Figure 12A:
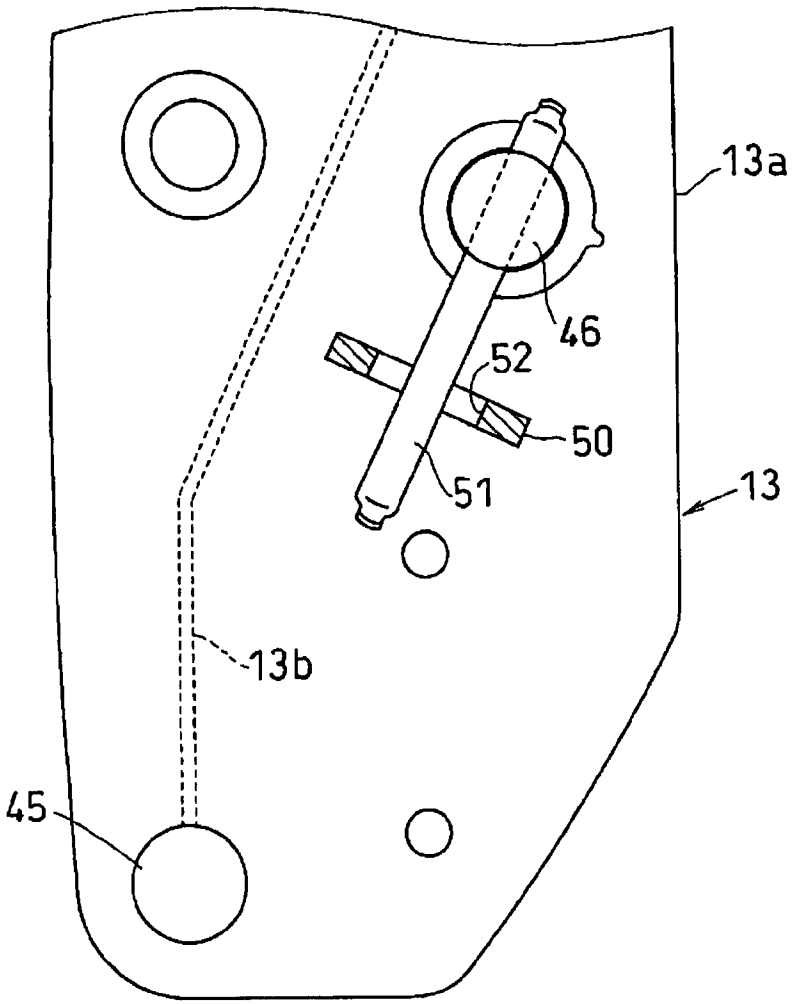
FIG. 12A is a side view showing a condition where a mount pin is inserted through a main frame and the side frame.
Figure 13:
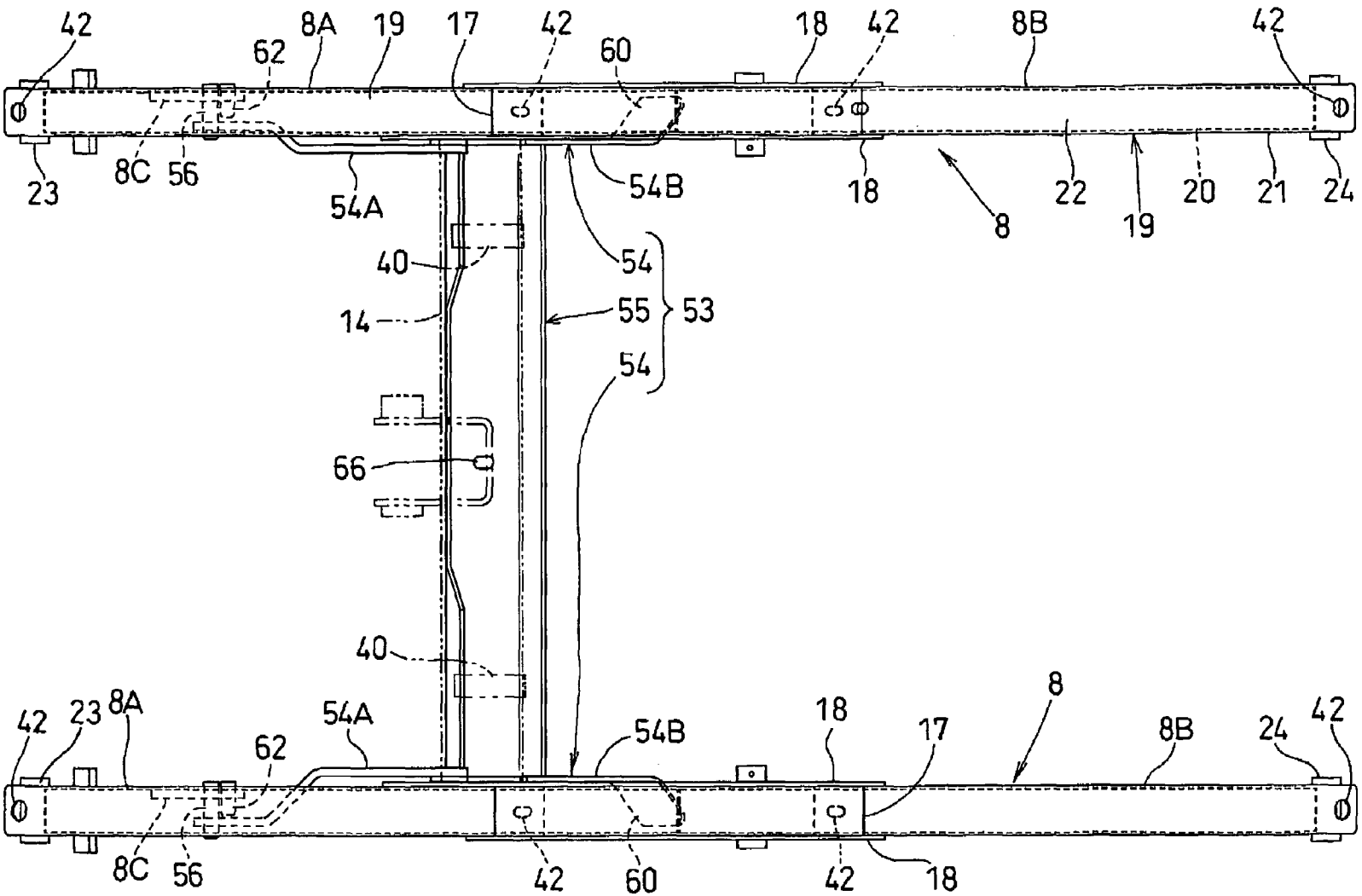
FIG. 13 is a view showing a boom and a stand relating to a second embodiment of the invention and corresponding to FIG. 2.
Figures 14A, 14B:
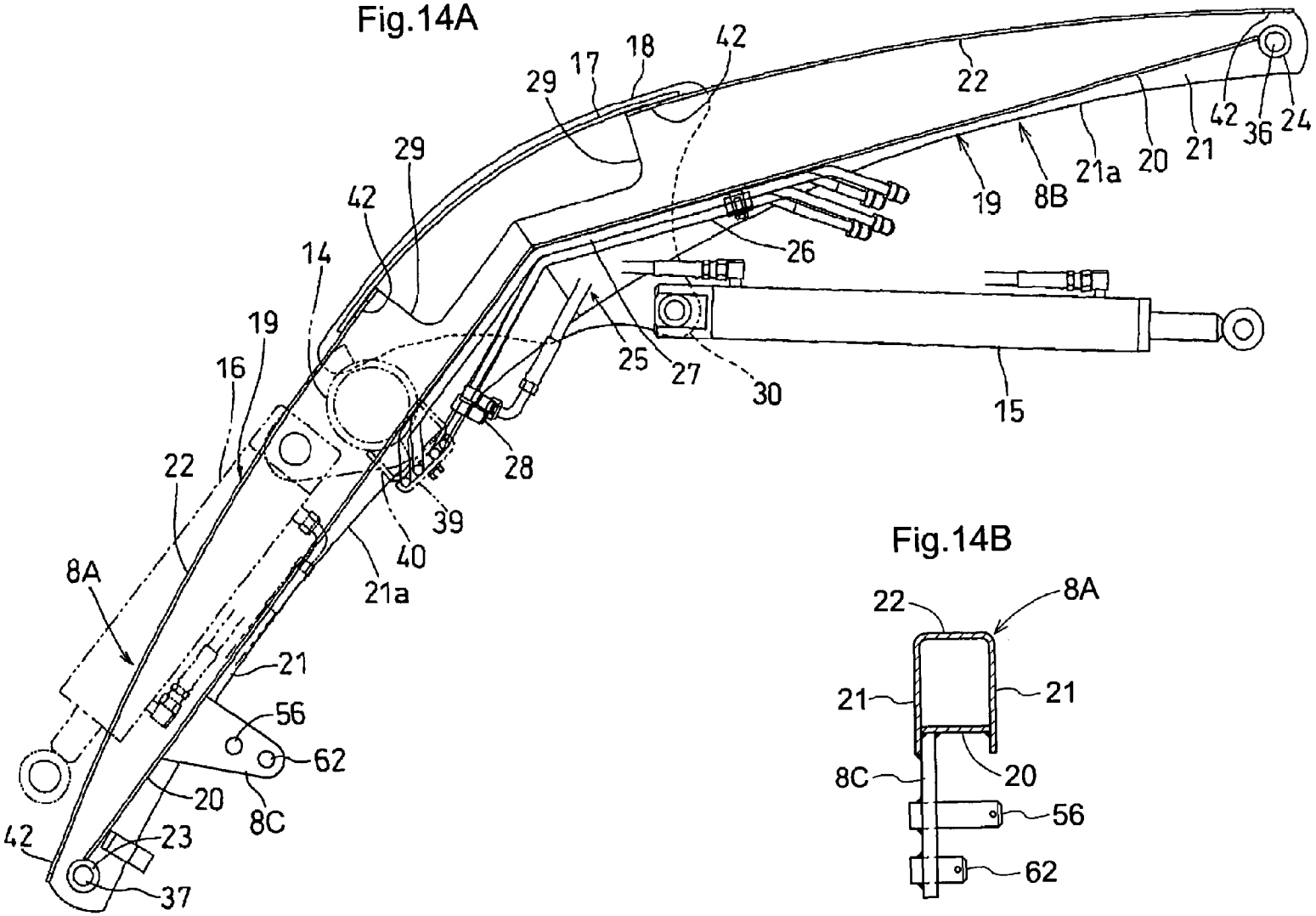
FIG. 14A is a side view in section showing the boom shown in FIG. 13 and corresponding to FIG. 3.
FIG. 14B is a section view showing a stay portion of the boom of FIG. 14A.
Figure 15A:
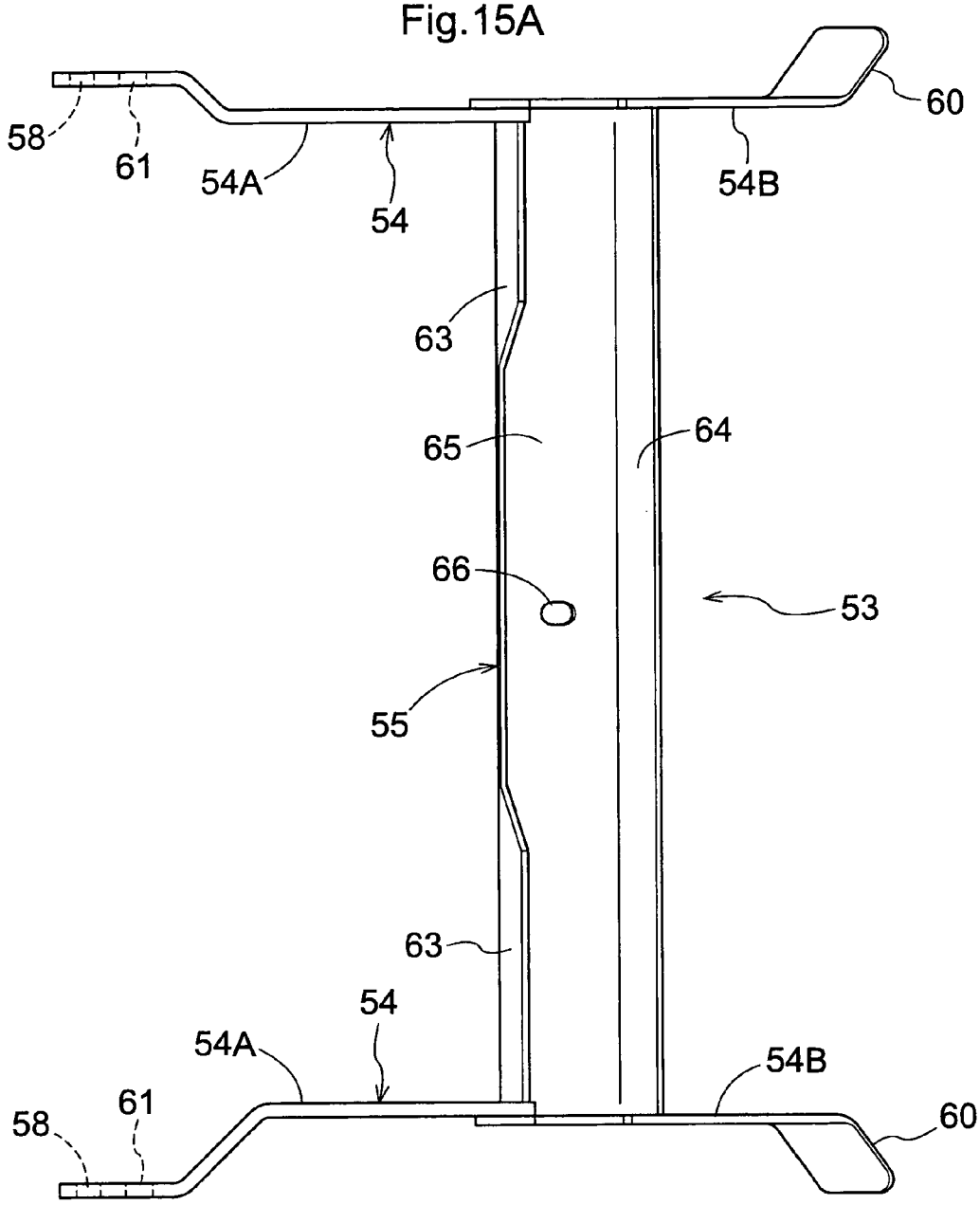
FIG. 15A is a plan view of the stand shown in FIG. 13.
Figure 15B:
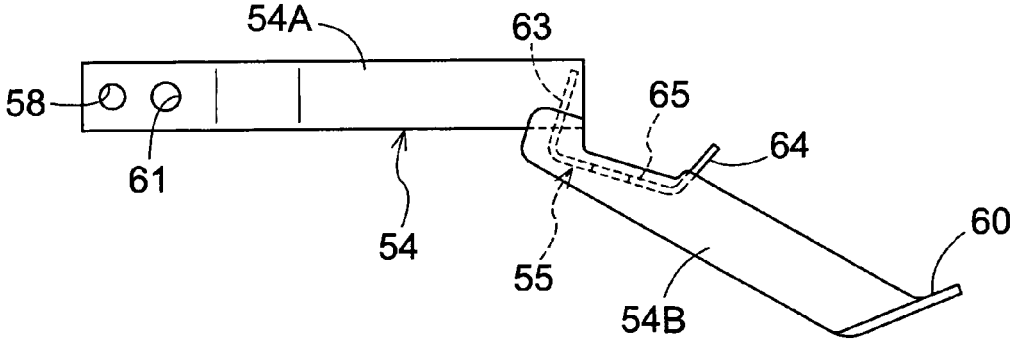
FIG. 15B is a side view of the stand shown in FIG. 15A.

Downwardly of the mount pin 46 on the outer face of the right/left outer lateral wall 13*a* of the side frame 13, there is provided a plate 50. And, at a right/left outer end portion of the mount pin 46, a stopper pin 51 extends radially therethrough, the stopper pin 51 having a smaller diameter than the mount pin 46. And, this stopper pin 51, as shown in FIG. 12A, is inserted through a through hole 52 formed in the plate 50. With this, inadvertent withdrawal of the mount pin 46 from the side frame 13 and the cylindrical member 47 is prevented. And, by upwardly withdrawing the stopper pin 51 from the insertion hole 52 of the plate 50, the mount pin 46 can be withdrawn from the side frame 13 and the cylindrical member 47.

The insertion hole 52 formed in the plate 50 is sized so as to allow insertion of the mount pin 46 therethrough. When the mount pin 46 is withdrawn from the side frame 13 and the cylindrical member 47, the mount pin 47 can be inserted into the insertion hole 52 of the plate 50 to be retained (accommodated) therein as shown in FIG. 12B.

Figure 8:
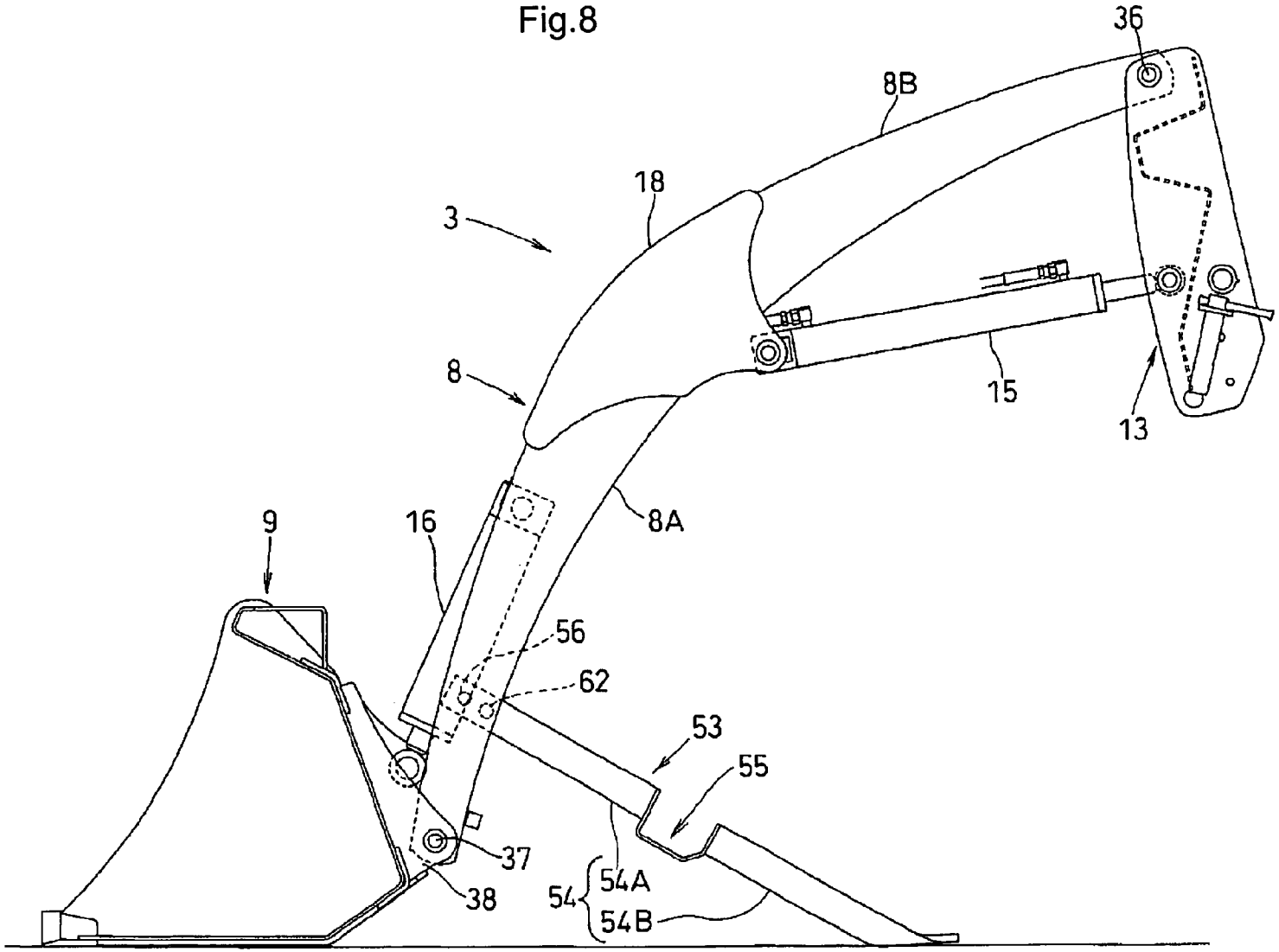
FIG. 8 is a side view showing the stand being set at its use position with detachment of the front loader.

The front loader 3 includes a stand unit (to be referred to simply as "stand" hereinafter) 53 for supporting the booms 8 with the bucket 9 being placed on the ground surface as shown in FIG. 8, when this front loader 3 is dismounted from the tractor 2.

As shown in FIG. 1, FIG. 2 and FIGS. 5-8, this stand 53 includes, as principal components thereof, a pair of, right and left stand members 54 provided in correspondence with the pair of right and left booms 8 and a stand connecting member 55 for interconnecting the right and left stand members 54. Front ends of the right and left stand members 54 are supported to the pivot shafts 56, 57 to be pivotable about the right/left axes. In operation, as the stand 53 is pivoted about these pivot shafts 56, 57, the stand 53 can be switched over between a use position shown in FIG. 8 where the right and left stand members 54 project downwardly from the respective booms 8 to contact the ground surface for supporting these booms 8, and a non-use position shown in FIGS. 1 and 5 where these stand members 54 extend along the respective booms 8.

Each of the right and left stand members 54 consists of two separate components, namely, a front component 54A disposed on the front side relative to the connecting member 55 and a rear component 54B disposed on the rear side relative to the connecting member 55. Each of these front and rear components 54A and 54B is formed of a band plate having its thickness direction aligned along the right/left direction. A rear end portion of the front component 54A is fixed by e.g. welding to a front face of the connecting member 55 and a front end portion of the rear component 54B is fixed by e.g. welding to a rear face of the connecting member 55.

At the front end portions of the front components 54A of the right and left stand members 54, there are respectively formed support holes 58, 59 extending therethrough along the thickness direction (right/left direction). The rear end portions of the rear components 54B of the right and left stand members 54 are bent inward in the right/left direction to form ground contact portions 60.

The support hole 58 of the front component 54A of one of the stand members (left stand member in this embodiment) 54 is formed as a round hole, whereas the support hole 59 of the front component 54*a* of the other of the stand members (right stand member in this embodiment) 54 is formed as a square angular hole, respectively.

The right and left pivot shafts 56, 57 for supporting the right and left stand members 54 are provided on the right/left inner face of the front portions of the right/left front boom components 8A as projections projecting from the right/left inner side, with the shafts 56, 57 having right/left axes and being arranged coaxially.

The left pivot shaft 56 is comprised of a cylindrical pin.

The right pivot shaft 57 is comprised of a pin formed by cutting away an axial center portion of a square column into a substantially cylindrical shape, so that the cylindrical portion formed at the axial center portion acts as a pivot allowing portion 57*a* for allowing the pivotal movement of the right stand member 54, whereas the square column portion on the right/left inner end acts as a pivot limiting portion 57*b* for limiting the pivotal movement of the right stand member 54.

As the support hole 58 of the left stand member 54 is engaged with the pivot shaft 56 and the support hole 59 of the right stand member 54 is engaged with the pivot allowing portion 57*a* of the right pivot shaft 57, the stand 53 can be pivoted about the right and left pivot shafts 56, 57, so that this stand 53 can be vertically pivoted (lifted up or down) about the pivot portions of the front portion thereof.

Since this stand 53 comprises the right and left stand members 54 interconnected by the connecting member 55, the position switchover operation of the stand 53 between the use position and the non-use position is made possible with only a lifting up or down operation from one of the right and left sides of the tractor 2.

Further, the right and left stand members 54 are pivotable on the right/left inner side of the booms 8, so that under the non-use condition, the right and left stand members 54 are located on the right/left inner side of the booms 8 so as to be overlapped with these booms 8 in the right/left direction.

With the above, under the non-use (accommodated) condition of the stand 53, the stand members 54 are concealed in view from the outer side by the booms 8, thus providing improved appearance of the stand 53 under its non-use condition.

Further, at the front portion of the front component 54A of the left stand member 54, there is formed a pin inserting hole 61 rearwardly of the support hole 58. On the right/left inner side face of the left boom 8, a retainer pin 62 is provided as a projection projecting to the right/left inner side, with the retainer pin 62 being located on an arc centering about the left pivot shaft 56 and having a radius corresponding to an inter-axis distance between the left pivot shaft 56 and the pin inserting hole 61. As shown in FIG. 6D, the pin inserting hole 61 and the retainer pin 62 have their axes substantially in agreement with each other in the right/left direction when the stand 53 is at the use position, so that the pin inserting hole 61 can be engaged with the retainer pin 62.

Figure 6A:
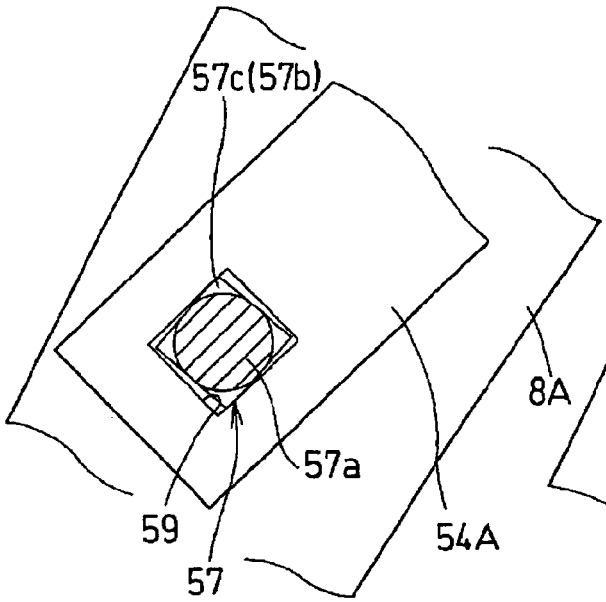
FIG. 6A is a side view showing a pivot portion of a right stand member at its non-use position.
Figure 6B:
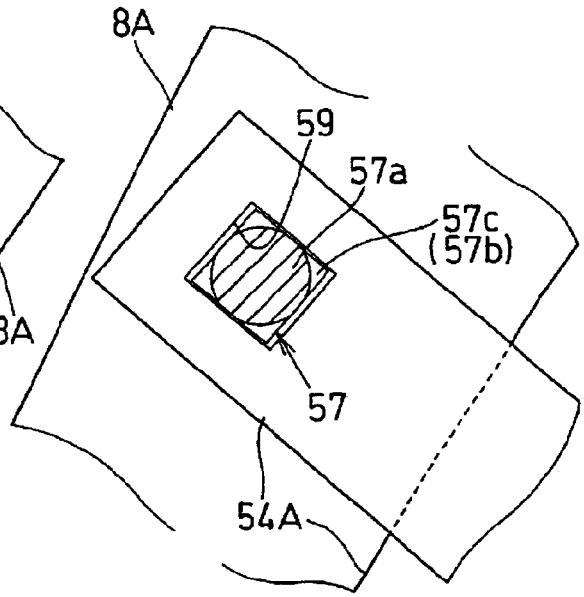
FIG. 6B is a side view showing the pivot portion of the right stand member at its use position.
Figure 6C:
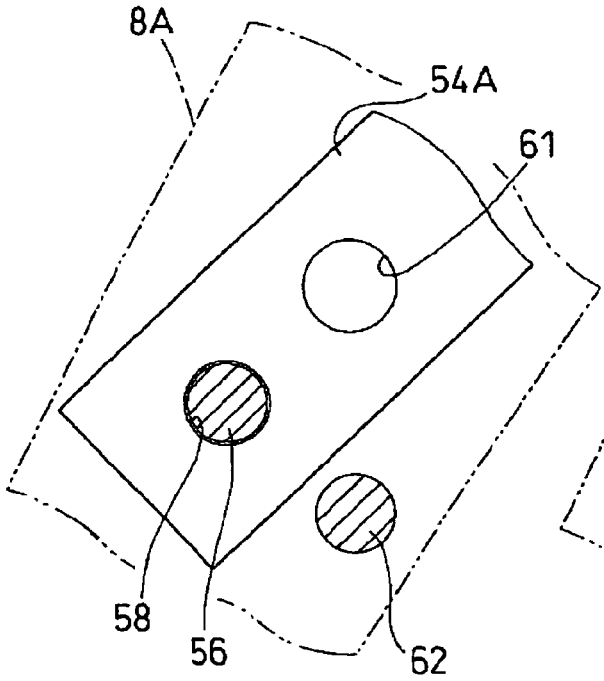
FIG. 6C is a side view showing a pivot portion of a left stand member at its non-use position.
Figure 6D:
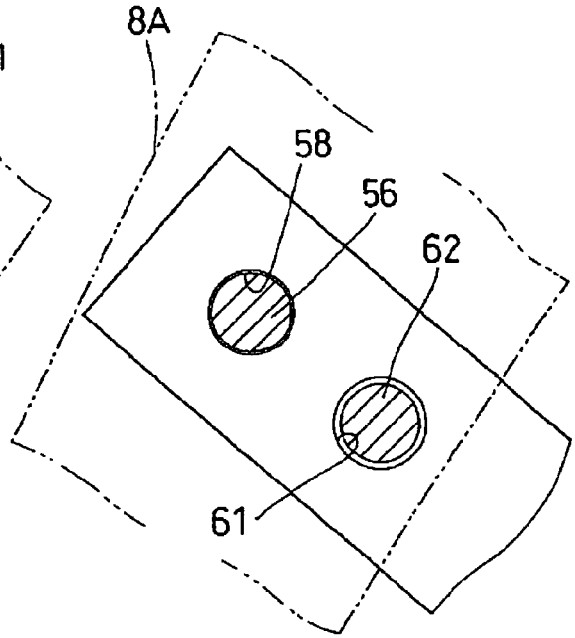
FIG. 6D is a side view showing the pivot portion of the left stand member at its use position.
Figure 7A:
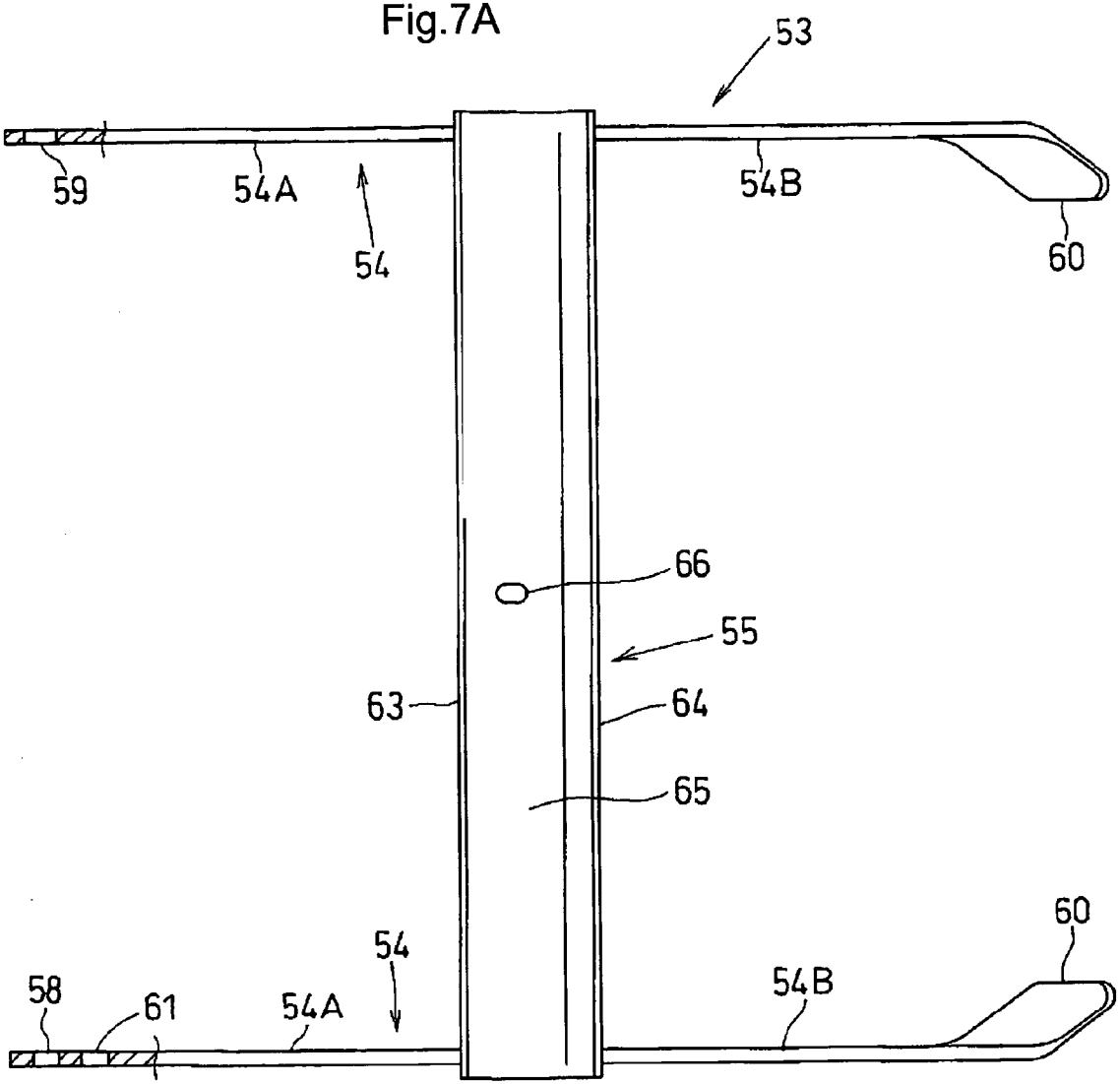
FIG. 7A is a plan view of the stand.
Figure 7B:
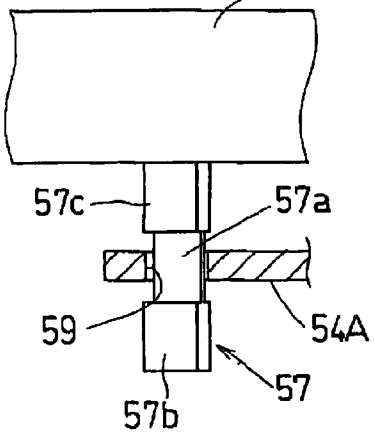
FIG. 7B is a partially enlarged section view of the pivot portion of the right stand member.
Figure 7C:
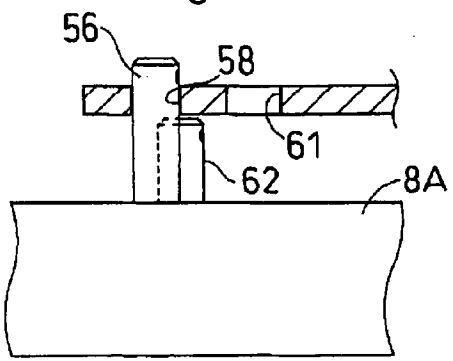
FIG. 7C is a partially enlarged section view of the pivot portion of the left stand member.

Further, when the stand 53 is at the use position, as shown in FIG. 6B, the support hole 59 of the right stand member 54 becomes engageable with the pivot allowing portion 57*a* of the right pivot shaft 57 and at the use position, the stand member 54 can be moved in the right/left direction (however, rightward movement of the stand 53 from the engaged condition between the right support hole 59 and the pivot allowing portion 57*a* is restricted by means of a stopper member such as a beta into the left pivot shaft 56).

Therefore, as the stand 53 located at the use position is moved to the left side from the engaged condition between the right support hole 59 and the pivot allowing portion 57*a*, the pin inserting hole 61 of the left stand member 54 will be engaged with the retainer pin 62 and the support hole 59 of the right stand member 54 will be engaged with the pivot limiting portion 57*b* of the right pivot shaft 57, whereby the pivotal movement of the stand 53 about the pivot shafts 56, 57 will be restricted and the stand 53 will be retained (locked) at the use position.

Under the above-described condition, when a stopper member such as a beta pin is inserted into the retainer pin 62, movement of the stand 53 to the right side is restricted.

Incidentally, the squire column portion 57*c* of the right pivot shaft 57 formed on the right/left outer side of the same is adapted for attachment/detachment of the stand 53. Hence, when the stand 53 is moved to the right side so as to bring the support hole 59 of the right stand member 54 into engagement with this square column portion 57*c*, the support hole 58 of the left stand member 54 will be disengaged from the left pivot shaft 56.

The connecting member 55 is provided in the form of a channel member which is open on the right and left sides and the upper side, having a front wall portion 63, a rear wall portion 64 and a bottom wall portion 65 connecting together lower ends of these front and rear wall portions 63, 64.

Figure 5A:
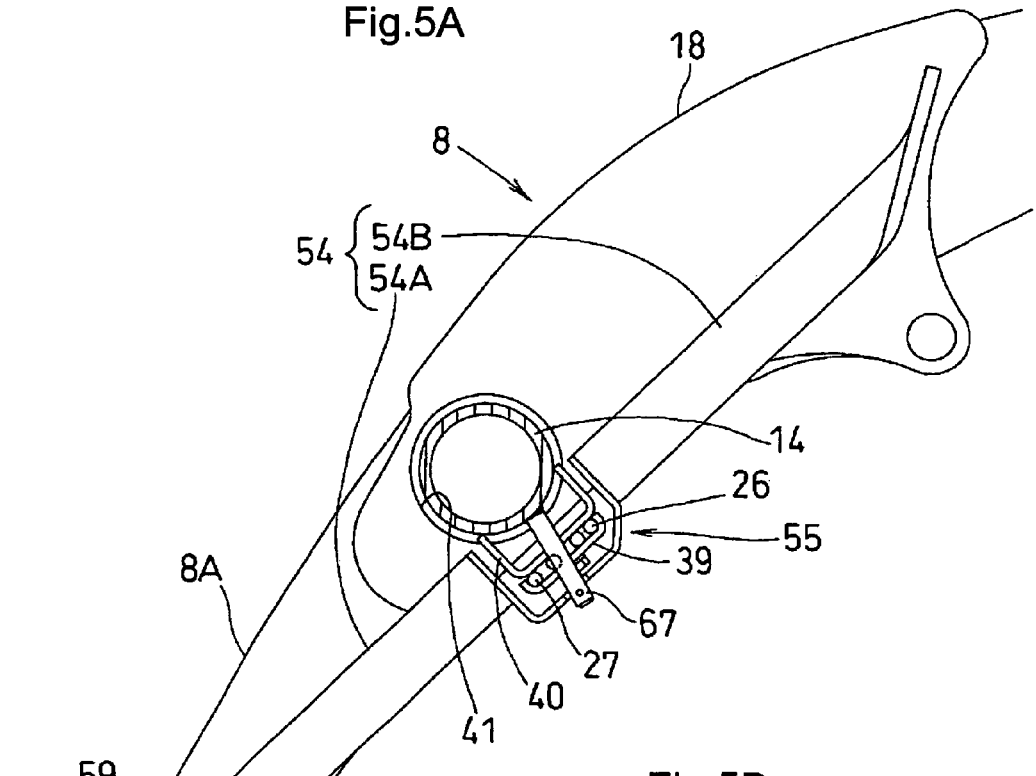
FIG. 5A is a side view of the boom and the stand under its non-use position as seen from a right/left center portion thereof.
Figure 5B:
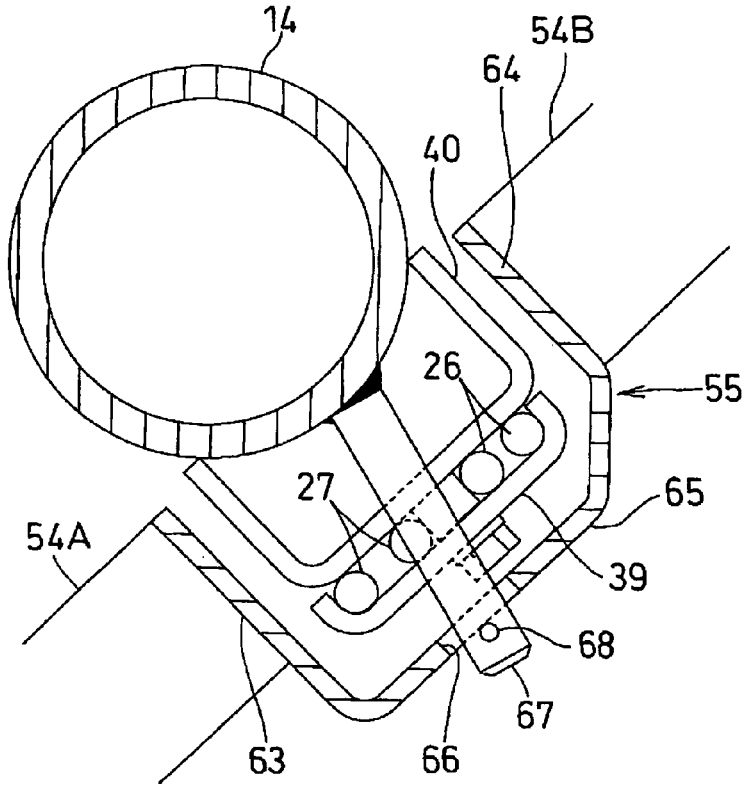
FIG. 5B is an enlarged section view of a portion where hydraulic pipe are covered with a stand connecting member.

Further, the connecting member 55 is configured such that when the stand 53 is set to the non-use position, as shown in FIGS. 5A and 5B, the connecting member 55 may be disposed under and along the boom connecting member 14 so as to cover the hydraulic pipes 26, 27, the attaching member 40 and the clamping member 39 disposed along this boom connecting member 14. In this way, when the stand 53 is not used, this connecting member 55 acts as a cover for protecting the hydraulic pipes 26, 27, etc.

Further, at a substantially right/left center portion of the bottom wall portion 65 of the connecting member 55, there is formed a pin inserting hole 66. Whereas, at a substantially right/left center portion of the lower face of the boom connecting member 14, there is fixed, as a projection, a retainer pin 67 which can be engaged with the pin inserting hole 66 when the stand 53 is at the non-use position.

Hence, by setting the stand 53 to the non-use position and inserting a stopper pin such as a beta pin into a stopper hole 68 of the retainer pin 67, the stand 53 can be retained (locked) at the non-use position.

As this retainer pin 67 is located at the substantially right/left center portion of the front loader 3, the insertion or withdrawal of the stopper pin to or from this retainer pin 67 is possible from either the right or left side of the tractor 2.

In operation, the front loader 3 having the above-described construction can be dismounted from the tractor 2 in the following manner, for example.

First, the leading end of the bottom of the bucket 9 will be brought into contact with the ground surface and the stand 53 will be lowered from the non-use position to the use position. Under this condition, the mount pin 46 will be withdrawn from the side frame 13 and the cylindrical member 47 of the main frame 12. This detached or withdrawn mount pin 46 will be inserted into the insertion hole 52 of the plate 50 to be retained therein.

Next, as the bucket cylinder 16 is contracted, the booms 8 will be lowered so that the ground contacting portions 60 of the stand 53 will contact the ground surface. Then, the booms 8 will be pivoted about the ground contacting portions 60 of the stand 53 with the side frames 13 being lifted up, so that the engaging pins 45 of the side frames 13 will be disengaged upwardly from the concave grooves 48 of the receiving member 49 of the main frame 12, so that as shown in FIG. 8, the front loader 3 assumes a standing posture with the booms 8 being supported by the stand 53, with the bottom of the bucket 9 being placed on the ground surface.

Thereafter, the hydraulic hoses connected from the hydraulic pipes 26, 27 of the front loader 3 to the control valve unit will be detached and the tractor 2 will be traveled backward.

The mounting operation of the front loader 3 to the tractor 2 can be effected by effecting the above-described operations in the reverse order.

Incidentally, the above-described mounting/dismounting operations of the front loader 3 are just exemplary. The front loader 3 can be mounted or dismounted by a different method than the method described above.

Second Embodiment

FIGS. 13, 14A, 14B, 15A and 15B show a second embodiment of the present invention. This embodiment differs from the first embodiment in terms of the constructions of the booms 8 and the stand 53 in the following respects.

From each of the right and left booms 8, a stay 8C projects respectively from the front end of the lower face thereof. To this stay 8C, the pivot shaft 56 and the retainer pin 62 are fixed by means of e.g. welding. More particularly, the right pivot shaft 56 is also comprised of a cylindrical pin, like the left pivot shaft 56.

In correspondence with the above, in the stand 53 of this embodiment, the right stand member 54 defines a circular support hole 58 and a circular pin inserting hole 61 just the like those of the left stand member 54. In order to allow the posture switchover of the stand 53, these holes, i.e. the support hole 58 and the pin inserting hole 61, are open in the same direction as the respective two left openings 58, 61.

The longitudinal center portion of the stand 53 can have a substantially same distance between the right and left stand members 54, 54 as that of the first embodiment so as to ensure sufficient support strength. Whereas, the front end of each stand member 54 is bent outward in the right/left direction for a pin-and-hole engagement with the stay 8C projecting downwardly from the boom 8. At the rear end side too, the ground contacting portion 60 is disposed with the right/left outer orientation. Further, the front and rear components 54A, 54B are slightly bent relative to each other, rather straight.

The rest of the construction is identical to the first embodiment. Hence, only the same reference marks and numerals are provided and explanation thereof will be omitted.

Third Embodiment

Figure 16:
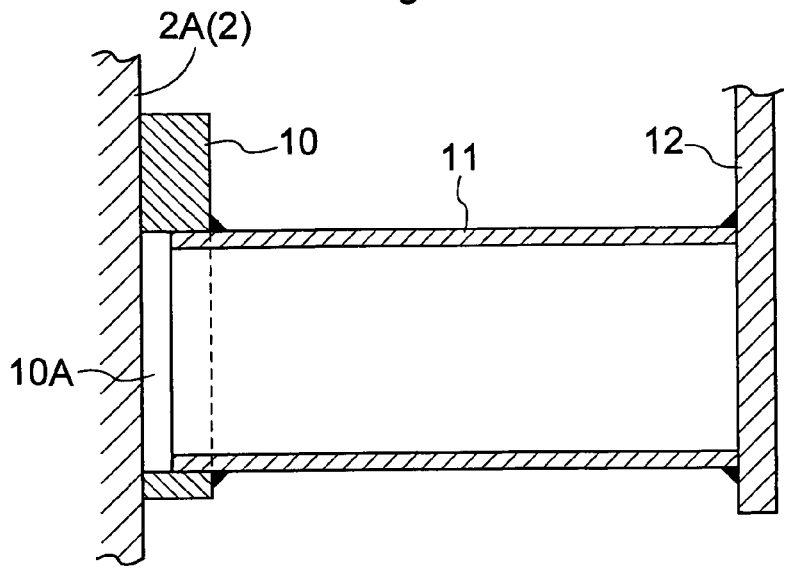
FIG. 16 is a view schematically illustrating a main frame mounting construction relating to a third embodiment of the present invention.

The construction for attaching the main frame 12 to the vehicle frame 2A of the tractor 2 can be an alternative construction shown in FIG. 16, instead of the one shown in FIG. 11.

In this embodiment, the attaching plate 10 defines a hole 10A into which the support base 11 can be inserted. After the insertion, an inner end outer peripheral portion of the support base 11 will be fixed to the attaching plate 10 by means of e.g. welding.

With this construction, by appropriately adjusting the amount of insertion of the support base 11 into the hole 10A, the right/left distance from the main frame 12 to the vehicle frame 2A can be adjusted as desired. Further, the provision of the hole 10A can facilitate the positioning of the support base 11 relative to the attaching plate 10.

The rest of the construction is identical to the first embodiment. Hence, only the same reference marks and numerals are provided and explanation thereof will be omitted.

Fourth Embodiment

Figure 17A:
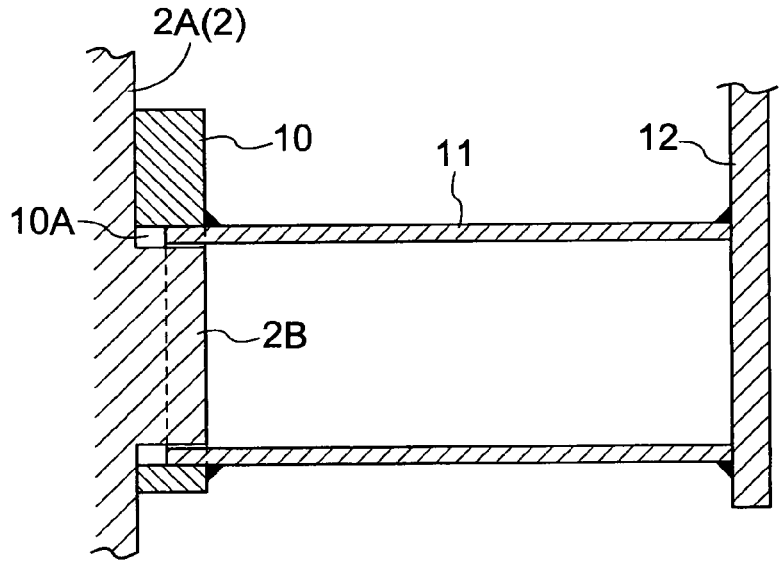
FIG. 17A is a view schematically illustrating a main frame amounting construction relating to a fourth embodiment of the present invention.
Figure 17B:
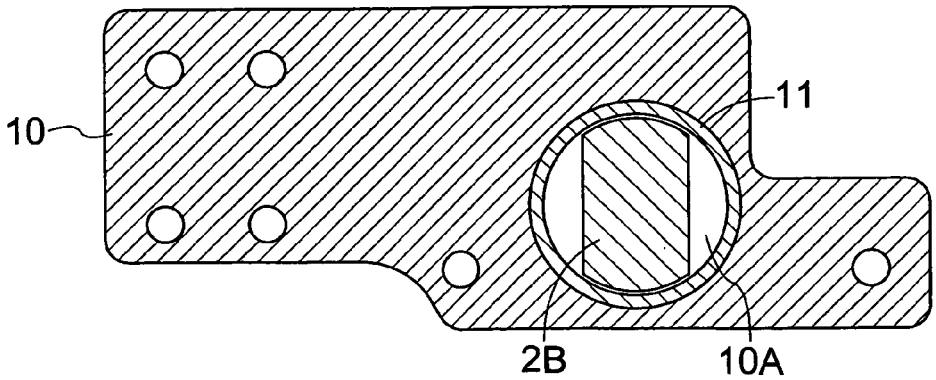
FIG. 17B is a section view showing a projecting portion of the vehicle frame shown in FIG. 17A.

The construction for attaching the main frame 12 to the vehicle frame 2A of the tractor 2 can be a still alternative construction shown in FIG. 17A and FIG. 17B, instead of the those shown in FIG. 11 and FIG. 16.

In this embodiment, the vehicle frame 2A includes integrally or fixedly by means of e.g. welding, a projection 2B projecting therefrom inside the hole 10A of the attaching plate 10 to the right/left outer side. With the provision of the projection 2B in this way, the fixing/attaching of the attaching plate 10 to the vehicle frame 2A can be easily carried out by hooking the hole 10A on the projection 2B. Further, by using this projection 2B as a target, one can easily carry out the positioning operation of the support base 11 also. After this positioning operation, an inner end outer peripheral portion of the support base 11 will be fixed to the attaching plate 10 by means of e.g. welding.

Further, like the third embodiment described above, by appropriately adjusting the amount of insertion of the support base 11 into the hole 10A, the right/left distance from the main frame 12 to the vehicle frame 12A can be adjusted as desired. Further, the provision of the hole 10A can facilitate the positioning of the support base 11 relative to the attaching plate 10.

Incidentally, if this projection 2B is caused to project further into engagement with the inner periphery of the cylindrical support base 11 as shown in FIG. 17A, the positioning operation relative to the support base 11 will be further facilitated. However, in this invention, the projecting amount or length is not particularly limited. It can be longer or shorter than the one described above. And, it is not absolutely needed for the projection 2B to reach the inner periphery of the support base 11 as shown in FIG. 17A.

Further, the vertical cross sectional shape of the projection 2B is not limited to the one shown in FIG. 17B. It can be e.g. a circular shape corresponding to the entire cross sectional area of the inner periphery of the support base 11 or a ring shape corresponding to the entire peripheral length thereof. Any desired shape can be employed in this invention. Moreover, the engagement between the projection 2B relative to the inner periphery of the support base 11 need not be such gapless engagement, but can be a loose engagement.

The rest of the construction is identical to the first embodiment and/or the third embodiment. Hence, only the same reference marks and numerals are provided and explanation thereof will be omitted.

Lastly, the construction of the second embodiment and the construction of the third or fourth embodiment can be employed at one time.

The invention claimed is:

1. A work vehicle comprising:

a pair of right and left booms detachably attached to a vehicle body;

an implement attached to leading ends of the booms; and a stand for supporting the booms with the implement being placed on a ground surface when the booms are detached from the vehicle body;

wherein said stand includes a pair of right and left stand members attached to the right and left booms to be pivotal relative to the booms, and a stand connecting member interconnecting said stand members, said stand connecting member allowing said right and left stand members to pivot in unison with each other between a use position in which both of said stand members project downwardly from the booms for supporting the booms and a non-use position in which both of said stand members extend along the booms; and wherein said right and left booms are interconnected at longitudinally intermediate portions thereof via a boom connecting member, and said stand connecting member, at its non-use position, is disposed along said boom connecting member so as to cover a hydraulic pipe disposed along said boom connecting member from under the pipe.

2. The work vehicle according to claim 1, wherein said each stand member comprises an assembly of separate components including a front component disposed on a front side of the stand connecting member and a rear component disposed on a rear side of the stand connecting member.

3. A work vehicle comprising:

a pair of right and left booms detachably attached to a vehicle body;

an implement attached to leading ends of the boom; and a stand for supporting the booms with the implement being placed on a ground surface when the booms are detached from the vehicle body;

wherein said stand includes a pair of right and left stand members attached to the right and left booms to be pivotal relative to the booms, and a stand connecting member interconnecting said stand members, said stand connecting member allowing said right and left stand members to pivot in unison with each other between a use position in which both of said stand members project downwardly from the booms for supporting the booms and a non-use position in which both of said stand members extend along the boom;

wherein said each boom has a first horizontal shaft projected therefrom, each said first horizontal shaft supports the stand member associated therewith to be shiftable in a longitudinal direction thereof and pivotable thereabout between said use position and said non-use position, and wherein, when in said use position, shifting the stand member in one way of said longitudinal direction regulates pivoting of the stand member to said non-use position and shifting the stand member in the other way of said longitudinal direction releases the pivot regulation; and wherein the first horizontal shaft associated with one of said booms defines a pivot limiting portion on said one way of said longitudinal direction and a pivot allowing portion on said other way of said longitudinal direction, and wherein, when in said use position, shifting the stand member to said pivot limiting portion regulates the pivoting of the stand member to said non-use position and shifting the stand member to said pivot allowing portion releases the pivot regulation.

4. A work vehicle comprising:

a pair of right and left booms detachably attached to a vehicle body;

an implement attached to leading ends of the booms; and a stand for supporting the booms with the implement being placed on a ground surface when the booms are detached from the vehicle body;

wherein said stand includes a pair of right and left stand members attached to the right and left booms to be pivotal relative to the booms, and a stand connecting member interconnecting said stand members, said stand connecting member allowing said right and left stand members to pivot in unison with each other between a use position in which both of said stand members project downwardly from the booms for supporting the booms and a non-use position in which both of said stand members extend along the booms;

wherein said each boom has a first horizontal shaft projected therefrom, each said first horizontal shaft supports the stand member associated therewith to be shiftable in a longitudinal direction thereof and pivotable thereabout between said use position and said non-use position, and wherein, when in said use position, shifting the stand member in one way of said longitudinal direction regulates pivoting of the stand member to said non-use position and shifting the stand member in the other way of said longitudinal direction releases the pivot regulation; and wherein at least one of said booms has a second horizontal shaft projected therefrom shorter than said first horizontal shaft and the stand member associated with said one boom defines a bore engageable with said second horizontal shaft, and wherein, when in said use position, shifting the stand member in said one way of said longitudinal direction engages said second horizontal shaft with said bore and regulates the pivoting of the stand member to said non-use position, and shifting the stand member in said other way of said longitudinal direction disengages said second horizontal shaft from said bore and releases the pivot regulation.

5. A work vehicle comprising:

a pair of right and left booms detachably attached to a vehicle body;

an implement attached to leading ends of the booms; and a stand for supporting the booms with the implement being placed on a ground surface when the booms are detached from the vehicle body;

wherein said stand includes a pair of right and left stand members provided in correspondence with the right and left booms and a stand connecting member for interconnecting said stand members, said each stand member being attached to the boom corresponding thereto in such a manner that the stand is movable between a use position in which each stand member projects downwardly from the boom for supporting the boom and a non-use position in which each stand member extends along the boom; and wherein said right and left booms are interconnected at longitudinally intermediate portions thereof via a boom connecting member, and said stand connecting member, at its non-use position, is disposed along said boom connecting member so as to cover a hydraulic pipe disposed along said boom connecting member from under the pipe.

6. The work vehicle according to claim 5, wherein said each stand member comprises an assembly of separate components including a front component disposed on a front side of the stand connecting member and a rear component disposed on a rear side of the stand connecting member.

7. The work vehicle according to claim 5, wherein said each boom has a first horizontal shaft projected therefrom, each said first horizontal shaft supports the stand member associated therewith to be shiftable in a longitudinal direction thereof and pivotable thereabout between said use position and said non-use position, and wherein, when in said use position, shifting the stand member in one way of said longitudinal direction regulates pivoting of the stand member to said non-use position and shifting the stand member in the other way of said longitudinal direction releases the pivot regulation; and wherein the first horizontal shaft associated with one of said booms defines a pivot limiting portion on said one way of said longitudinal direction and a pivot allowing portion on said other way of said longitudinal direction, and wherein, when in said use position, shifting the stand member to said pivot limiting portion regulates the pivoting of the stand member to said non-use position and shifting the stand member to said pivot allowing portion releases the pivot regulation.

8. The work vehicle according to claim 5, wherein said each boom has a first horizontal shaft projected therefrom, each said fmrst horizontal shaft supports the stand member associated therewith to be shiftable in a longitudinal direction thereof and pivotable thereabout between said use position and said non-use position, and wherein, when in said use position, shifting the stand member in one way of said longitudinal direction regulates pivoting of the stand member to said non-use position and shifting the stand member in the other way of said longitudinal direction releases the pivot regulation; and wherein at least one of said booms has a second horizontal shaft projected therefrom shorter than said first horizontal shaft and the stand member associated with said one boom defines a bore engageable with said second horizontal, shaft, and wherein, when in said use position, shifting the stand member in said one way of said longitudinal direction engages said second horizontal shaft with said bore and regulates the pivoting of the stand member to said non-use position, and shifting the stand member in said other way of said longitudinal direction disengages said second horizontal shaft from said bore and releases the pivot regulation.

9. A work vehicle comprising:

a pair of right and left booms detachably attached to a vehicle body;

an implement attached to leading ends of the booms; and a stand for supporting the booms with the implement being placed on a ground surface when the booms are detached from the vehicle body;

wherein said stand includes a pair of right and left stand members provided in correspondence with the right and left booms and a stand connecting member for interconnecting said stand members, said each stand member being attached to the boom corresponding thereto in such a manner that the stand is movable between a use position in which each stand member projects downwardly from the boom for supporting the boom and a non-use position in which each stand member extends along the boom; and wherein said each stand member comprises an assembly of separate components including a front component disposed on a front side of the stand connecting member and a rear component disposed on a rear side of the stand connecting member.

10. The work vehicle according to claim 9, wherein said each boom has a first horizontal shaft projected therefrom, each said first horizontal shaft supports the stand member associated therewith to be shiftable in a longitudinal direction thereof and pivotable thereabout between said use position and said non-use position, and wherein, when in said use position, shifting the stand member in one way of said longitudinal direction reaulates pivoting of the stand member to said non-use position and shifting the stand member in the other way of said longitudinal direction releases the pivot regulation; and wherein the first horizontal shaft associated with one of said booms defines a pivot limiting portion on said one way of said longitudinal direction and a pivot allowing portion on said other way of said longitudinal direction, and wherein, when in said use position, shifting the stand member to said pivot limiting portion regulates the pivoting of the stand member to said non-use position and shifting the stand member to said pivot allowing portion releases the pivot regulation.

11. The work vehicle according to claim 9, wherein said each boom has a first horizontal shaft projected therefrom, each said first horizontal shaft supports the stand member associated therewith to be shiftable in a longitudinal direction thereof and pivotable thereabout between said use position and said non-use position, and wherein, when in said use position, shifting the stand member in one way of said longitudinal direction regulates pivoting of the stand member to said non-use position and shifting the stand member in the other way of said longitudinal direction releases the pivot regulation; and wherein at least one of said booms has a second horizontal shaft projected therefrom shorter than said first horizontal shaft and the stand member associated with said one boom defines a bore engageable with said second horizontal shaft, and wherein, when in said use position, shifting the stand member in said one way of said longitudinal direction engages said second horizontal shaft with said bore and regulates the pivoting of the stand member to said non-use position, and shifting the stand member in said other way of said longitudinal direction disengages said second horizontal shaft from said bore and releases the pivot regulation.

* * * * *

UNITED STATES PATENT AND TRADEMARK OFFICE

CERTIFICATE OF CORRECTION

PATENT NO. : 7,354,238 B2
APPLICATION NO. : 11/226896
DATED : April 8, 2008
INVENTOR(S) : Fukudome et al.

It is certified that error appears in the above-identified patent and that said Letters Patent is hereby corrected as shown below:

Column 14, line 60, Claim 8, “fmrst horizontal” should read -- first horizontal --

Column 16, line 3, Claim 10, “direction reaulates” should read -- direction regulates --

Signed and Sealed this

Ninth Day of September, 2008

JON W. DUDAS
*Director of the United States Patent and Trademark Office*